US005876256A

United States Patent [19]

Takahashi et al.

[11] Patent Number: 5,876,256

[45] Date of Patent: Mar. 2, 1999

[54] ENGINE COOLING SYSTEM

[75] Inventors: Masanori Takahashi; Hiroshi Oishi, both of Hamamatsu, Japan

[73] Assignee: Sanshin Kogyo Kabushiki Kaisha, Hamamatsu, Japan

[21] Appl. No.: 814,215

[22] Filed: Mar. 11, 1997

[30] Foreign Application Priority Data

Mar. 11, 1996 [JP] Japan ..... 8-082008
Apr. 5, 1996 [JP] Japan ..... 8-108592

[51] Int. Cl.[6] ..... B63H 20/28
[52] U.S. Cl. ..... 440/1; 440/88
[58] Field of Search ..... 440/1, 2, 88, 89; 123/196 W; 184/104.3

[56] References Cited

U.S. PATENT DOCUMENTS 4,399,797 8/1983 Iwai .
4,669,988 6/1987 Brackenfeld et al. ..... 440/88
4,836,123 6/1989 Grinde et al. ..... 440/113
4,898,261 2/1990 Winberg et al. ..... 184/104.3
5,036,804 8/1991 Shibata .
5,038,724 8/1991 Neal et al. ..... 440/88
5,048,467 9/1991 Kojima .
5,109,809 5/1992 Fujimoto .
5,215,164 6/1993 Shibata et al. ..... 123/196 W
5,251,577 10/1993 Kojima .
5,330,376 7/1994 Okumura .

*Primary Examiner*—Sherman Basinger
*Attorney, Agent, or Firm*—Knobbe, Martens, Olson & Bear LLP

[57] ABSTRACT

A liquid cooling system for an internal combustion engine of an outboard motor is disclosed. The cooling system includes a pump for delivering coolant to one or more coolant passages in the engine. At least one thermostat is provided for controlling the flow of coolant through the engine to one or more return lines which extend to a coolant pool extending about a lubricating oil reservoir. A pressure relief valve is provided between the pump and thermostat for relieving coolant from the engine upon excessive coolant pressure. The relieved coolant is preferably either delivered to a drain, a second coolant pool extending about a muffler, or the first coolant pool. Preferably, a diverter is provided for controlling the flow of the relieved coolant. When a temperature of the lubricating oil is high, the relieved coolant is preferably diverted to the first coolant pool for additionally cooling the oil in the reservoir, and when the temperature of the oil is low, the relieved coolant is preferably either diverted to the second coolant pool or the coolant drain for passage out of the motor.

32 Claims, 22 Drawing Sheets

ENGINE COOLING SYSTEM

FIELD OF THE INVENTION

The present invention relates to a cooling system for an internal combustion engine. In particular, the present invention is a liquid cooling system for an engine of the type powering an outboard motor and having a number of cooling liquid passages therethrough and at least one thermostat and pressure relief valve for controlling the flow of cooling liquid through the engine.

BACKGROUND OF THE INVENTION

Watercraft are often powered by outboard motors positioned at the stem of the craft. These motors have an internal combustion engine positioned within a cowling of the motor. Among other reasons, because the outboard motor is positioned at the stem of the craft, and because the motor is tiltable, it is desirable to keep the engine's size and weight to a minimum.

In order to keep the engine small, its various parts are typically mounted much closer to one another than might be the case with similar types of engines utilized in other settings. One problem which arises in these engines relates to keeping various of the components of the engine cool when they are so close to one another. The cooling problem is further aggravated by the fact that the engine is positioned within an enclosed cowling, trapping the heat therein.

It is especially important that the combustion chambers be cooled adequately, and be isolated from heat transfer from other portions of the engine. If the combustion chambers become too hot, the combustion efficiency is greatly reduced, lessening engine power output. In addition, if the combustion chambers become too hot, the lubricating oil may be scorched and burned, reducing its effectiveness. In addition, the cylinder walls, pistons or rings may be warped or damaged. The lubricating oil must be adequately cooled so that it does not break down and so that it does not transmit heat to the engine.

At the same time, when the engine is first started, it must heat up to a desired operating temperature in order for it to run efficiently. The lubricating oil is also desirably heated to a somewhat elevated temperature so that it flows freely throughout the engine.

A liquid cooling arrangement for an internal combustion engine which both cools the engine and yet provides for engine warm-up, is desirable.

SUMMARY OF THE INVENTION

In accordance with the present invention, there is provided an improved liquid cooling system for an internal combustion engine. The present invention is particularly useful with engines comprising a cylinder block having at least one head connected thereto and cooperating therewith to define one or more combustion chambers. Preferably, the engine is utilized to power a watercraft, and is mounted within a cowling of an outboard motor.

In accordance with the present invention, the engine includes a cooling liquid delivery mechanism, preferably in the form of a water pump. Cooling liquid is delivered through various passages in the cylinder block and cylinder head(s) of the engine. In addition, the engine preferably includes an oil reservoir from which oil is pumped for delivery throughout the engine. A cooling liquid pool is provided about the oil reservoir for selectively cooling the oil therein.

The cooling system of the present invention includes at least one thermostat for selectively permitting cooling liquid to flow through the cooling liquid passages in the engine. When the cooling liquid temperature is low, the thermostat closes, preventing cooling liquid from flowing through the engine. This allows the engine to warm up, such as when it is first started. Once the engine is warmed up and the cooling liquid temperature is above a predetermined high temperature, the thermostat opens, permitting cool cooling liquid to flow through the engine.

In addition, the cooling system includes at least one pressure relief valve. Preferably, this valve is positioned upstream of the thermostat along the cooling liquid flow path through the engine. When the cooling liquid pressure is high, but either the thermostat is closed or the oil temperature is low, cooling liquid is preferably diverted from the engine through the valve to a drain or a cooling liquid pool surrounding a muffler of the exhaust system of the engine. When the cooling liquid pressure is high, but the thermostat is open and/or the temperature of the oil is indicated as high, cooling liquid diverted by the valve is preferably delivered to the cooling liquid pool surrounding the oil reservoir for cooling the oil therein.

In a preferred embodiment, a diverter valve is utilized to determine the flow path of cooling liquid which is relieved through the pressure relief valve. The diverter valve is arranged to deliver, in one position, cooling liquid to the cooling liquid pool about the oil reservoir, and in another position, cooling liquid to the drain or the cooling liquid pool about the muffler.

Further objects, features, and advantages of the present invention over the prior art will become apparent from the detailed description of the drawings which follows, when considered with the attached figures.

BRIEF DESCRIPTION OF THE DRAWINGS

FIG. 22(*b*) is a schematic illustrating a second position of the diverter illustrated in FIG. 21.

DETAILED DESCRIPTION OF THE PREFERRED EMBODIMENTS OF THE INVENTION

In accordance with the present invention, there is provided an outboard motor 20 having an engine having cooling arrangement in accordance with the present invention.

Figure 1:
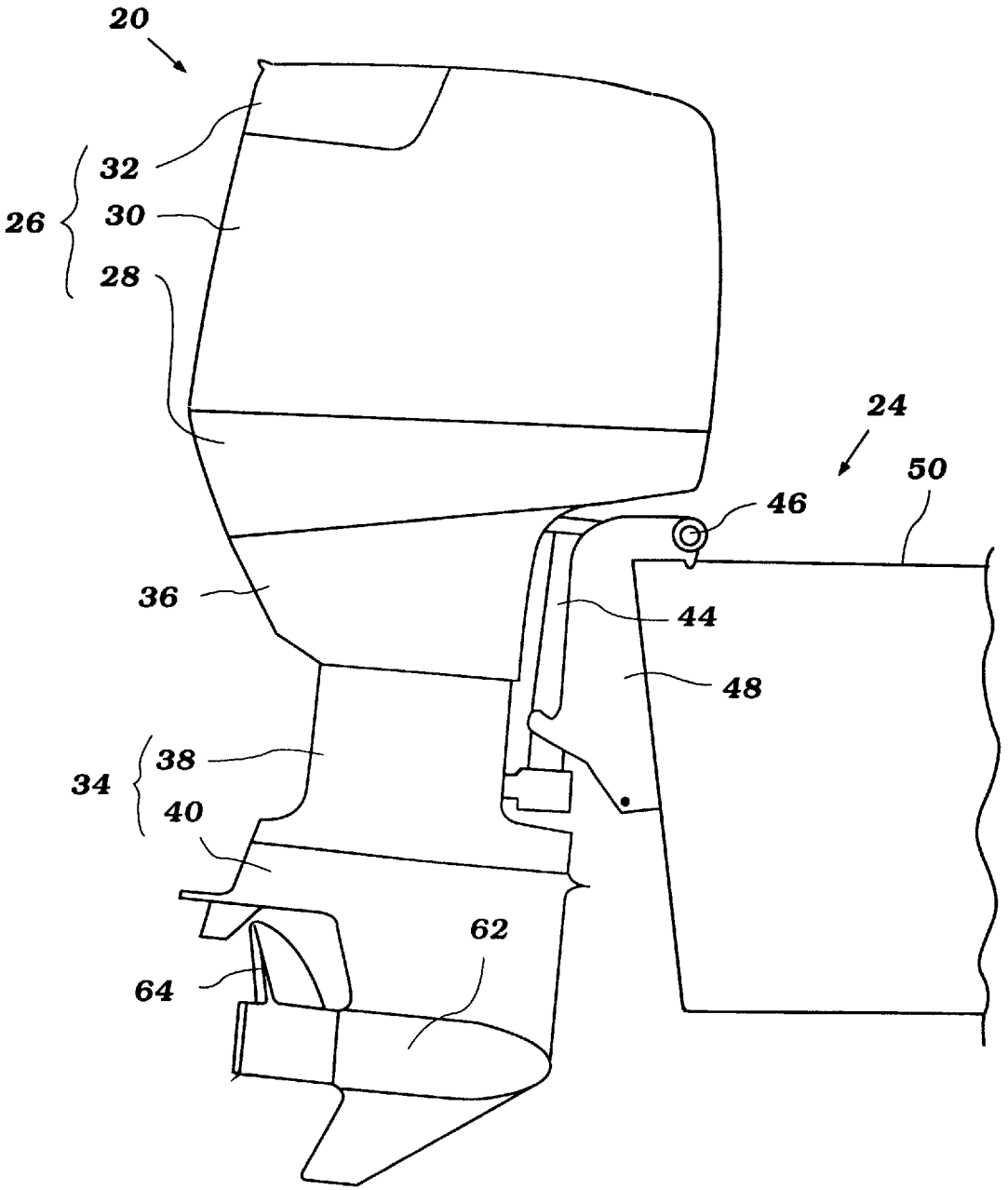
FIG. 1 is a side view of an outboard motor connected to a hull of a watercraft for powering the watercraft.

As best illustrated in FIG. 1, the outboard motor 20 is utilized to power a watercraft 24. The outboard motor 20 has a powerhead area 26 comprised of a lower tray portion 28 and a main cowling portion 30. An air inlet or vent 32 is provided in the main cowling portion 30 for providing air to an engine therein, as described in more detail below. The motor 20 includes a lower unit 34 extending downwardly therefrom, with an apron 36 providing a transition between the powerhead 26 and the lower unit 34. The lower unit 34 comprises an upper or "drive shaft housing" section 38 and a lower section 40.

A steering shaft, not shown, is affixed to the lower section 40 of the lower unit 34 by means of a bracket 42. The steering shaft is supported for steering movement about a vertically extending axis within a swivel bracket 44. The swivel bracket 44 is connected by means of a pivot pin 46 to a clamping bracket 48 which is attached to a transom portion of a hull 50 of the watercraft. The pivot pin 46 permits the outboard motor 20 to be trimmed and tilted up about the horizontally disposed axis formed by the pivot pin 46.

Figure 2:
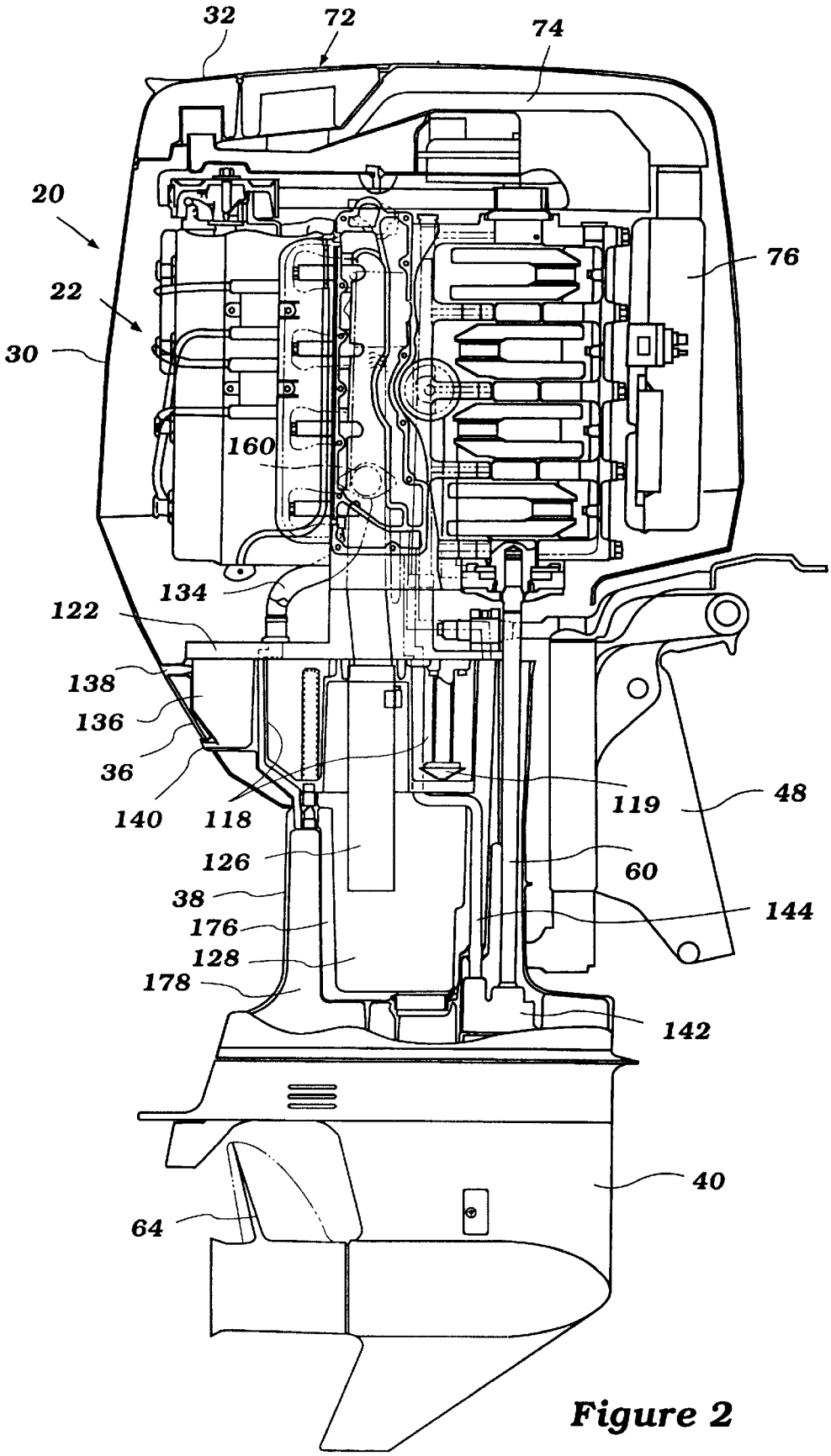
FIG. 2 is a side view, in partial cross-section, illustrating an internal combustion engine of the inline variety having an exhaust cooling arrangement in accordance with the present invention for use in powering the motor illustrated in FIG. 1.
Figure 3:
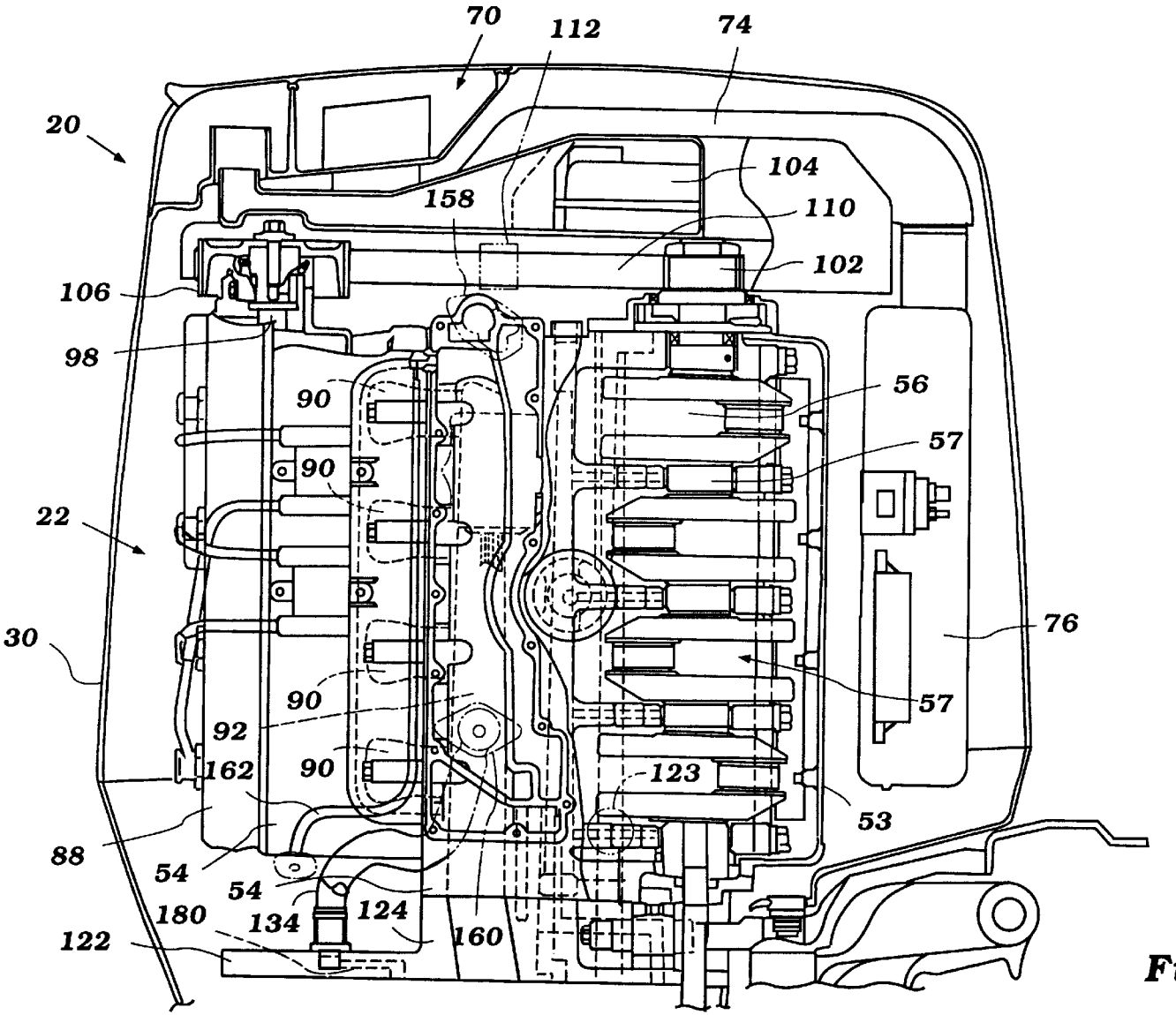
FIG. 3 is an enlarged view of a the engine illustrated in FIG. 2.

As best illustrated in FIG. 2 and 3, the power head 26 of the outboard motor 20 includes the engine 22 which is positioned within the cowling portion 30. In the embodiment of the present illustrated in FIGS. 1-8, the engine 22 is preferably of the inline, four-cylinder, four-cycle variety, and thus includes a cylinder block 52 which has a cylinder bank closed by a cylinder head assembly 54 in a manner which will be described. As also illustrated in FIGS. 2 and 3, the engine 22 is preferably oriented within the cowling 30 such that its cylinder head 54 is positioned on the block 52 on the side opposite the watercraft's transom.

A crankshaft 56 is rotatably journalled in a crankcase chamber formed by the cylinder block 52 a crankcase cover 50. As is typical with outboard motor practice, the engine 22 is mounted in the power head 26 so that the crankshaft 56 rotates about a vertically extending axis. This facilitates coupling to a drive shaft 60 in a manner which will be described.

The drive shaft 60 depends into the lower unit 34, wherein it drives a bevel gear and a conventional forward-neutral-reverse transmission. The transmission is not illustrated herein, because its construction per se forms no part of the invention. Therefore, any known type of transmission may be employed.

The transmission drives a propeller shaft which is journalled within the lower section 40 of the lower unit 34 in a known manner. A hub 62 of a propeller 64 is coupled to the propeller shaft for providing a propulsive force to the watercraft 24 in a manner well known in this art.

Figure 7:
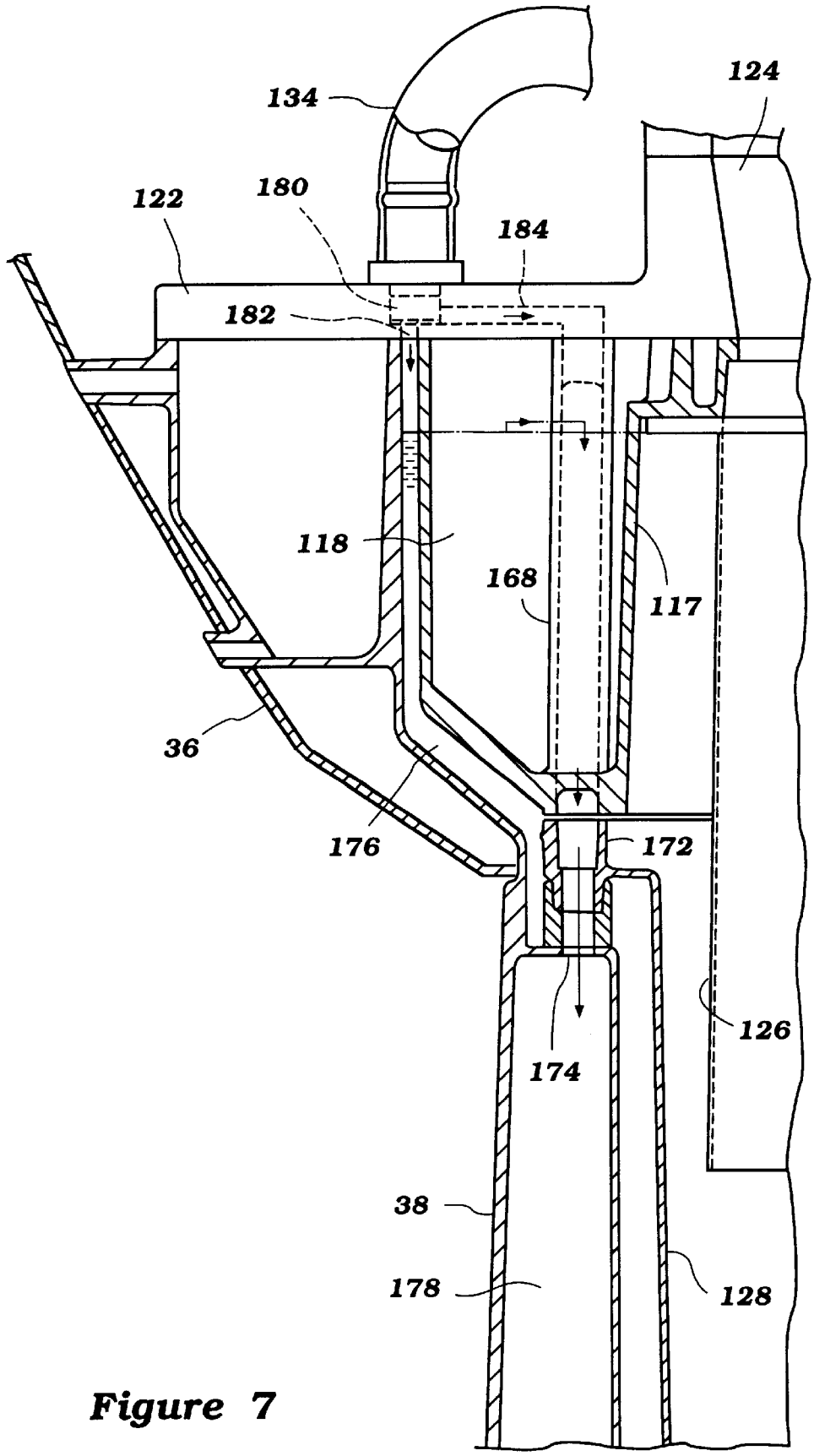
FIG. 7 is an enlarged, partial cross-sectional view of a lower portion of the motor illustrated in FIG. 1, illustrating a first embodiment cooling liquid pressure relief drain path in accordance with the present invention.

The construction of the engine 22 and the cooling arrangement of the present invention will now be described in more detail. As illustrated in FIGS. 2, 3 and 7, the engine 22 has a number of variable volume combustion chambers 59, preferably totaling four in number, arranged in inline fashion. It should be understood that there may be as few a one combustion chamber, or more than four.

Each combustion chamber has a piston 66 mounted therein for reciprocation, the piston connected to the crankshaft 56 via a connecting rod 68. The crankshaft 56 rotates within a crankcase chamber 57 defined by the cylinder block 52 and a cover or pan 53 connected thereto. The cylinder head 54 is preferably connected to the cylinder block 52 via a number of bolts, as is known in the art.

As illustrated in FIGS. 2, 3, 5 and 7, an intake system 70 provides air to each combustion chamber. The intake system 70 includes an air intake 72 positioned adjacent the vent 32 in the cowling 30. As best illustrated in FIG. 2, air drawn through this intake 72 passes into an air passage formed between the cowling 30 and a camshaft drive cover 74 positioned on the top of the engine 22, to a surge tank 76. Air is routed from the surge tank 76 by a runner 78 to an passage 80 positioned within the cylinder head 54 leading to the combustion chamber. An inlet passage 80 is provided corresponding to each combustion chamber 59.

Means are provided for controlling the passage of air through each inlet passage 80 to the combustion chambers 59. Preferably, this means comprises an intake valve 82. As illustrated, all of the intake valves 82 are preferably actuated by an intake camshaft 84. The intake camshaft 84 is mounted for rotation with respect to the head 54 and connected thereto with at least one bracket 86. The camshaft 84 is enclosed by a camshaft cover 88 which is connected to the head 54.

An exhaust system is provided for routing the products of combustion within the combustion chambers 59 to a point external to the engine 22. In particular, an exhaust passage 90 leads from each combustion chamber to a passage 92 in an exhaust manifold portion 94 of the engine 22. The remainder of the exhaust system will be described in more detail below.

Means are also provided for controlling the flow of exhaust from each combustion chamber 59 to its respective exhaust passage 92. Preferably, this means comprises an exhaust valve 96. Like the intake valves 82, the exhaust valves 96 are preferably all actuated by an exhaust camshaft 98. The exhaust camshaft 98 is journalled for rotation with respect to the cylinder head 54 and connected thereto with at least one bracket 100. The exhaust camshaft 98 is enclosed within the camshaft cover 88.

Figure 5:
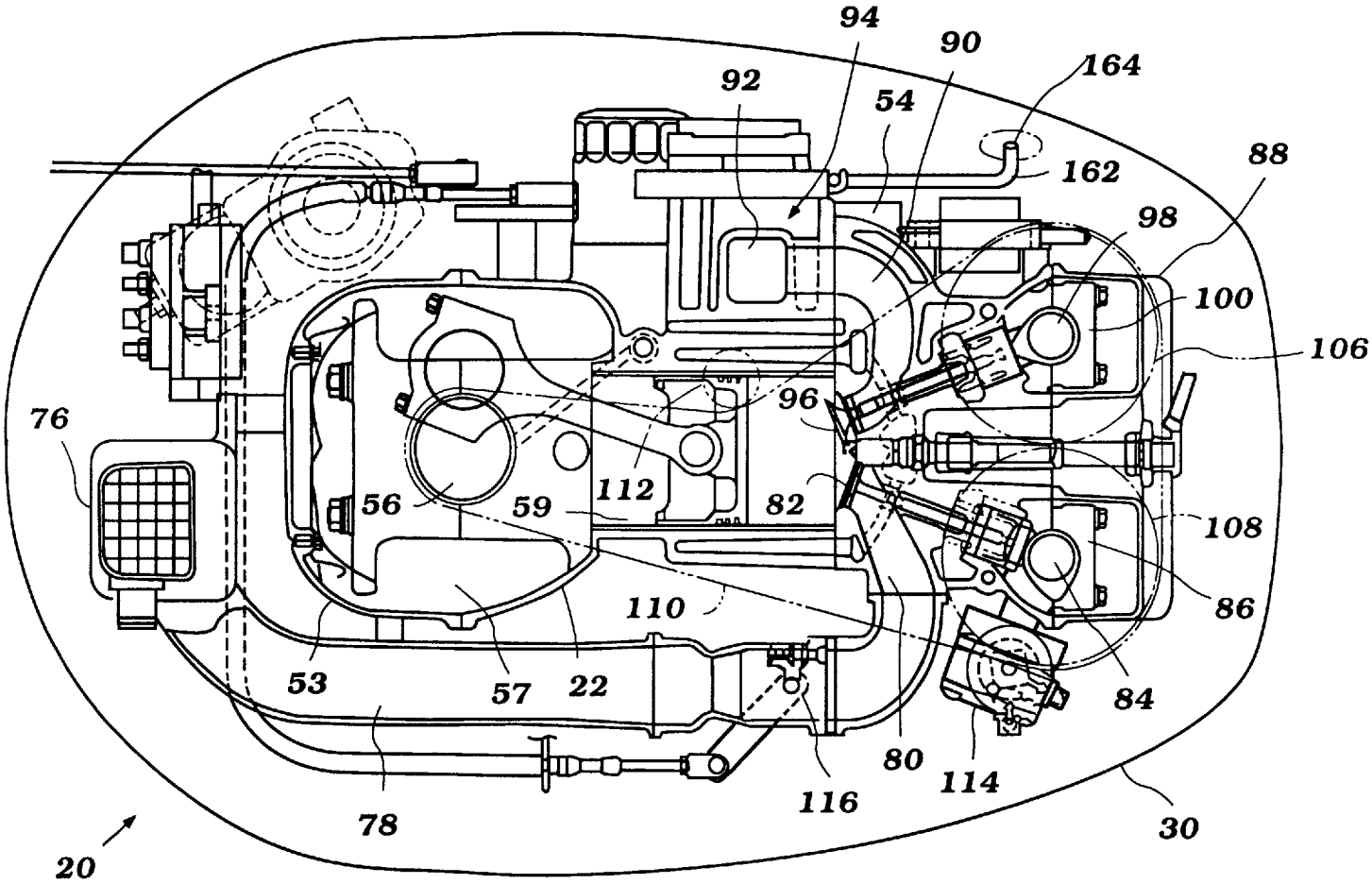
FIG. 5 is a top view of the engine illustrated in FIG. 2.

As best illustrated in FIGS. 3 and 5, means are provided for driving the camshafts 84,98. A timing belt pulley 102 is mounted on a top end of the crankshaft 56 positioned outside of the cylinder block 52, and just below a flywheel 104 also positioned on the crankshaft 56. An exhaust camshaft pulley 106 is mounted on an end of the exhaust camshaft 98 extending from the top end of the engine 22, and an intake camshaft pulley 108 is mounted on an end of the intake camshaft 84 extending from the top end of the engine. A drive belt 110 extends around the timing belt pulley 102 and the exhaust and intake camshaft pulleys 106,108, whereby the camshaft 56 indirectly drives the camshafts 84,98. One or more tensioner pulleys 112 may be provided for maintaining the belt in a taunt condition.

A fuel delivery system is provided for delivering fuel to each combustion chamber 59 for combustion therein. The fuel delivery system preferably includes a fuel tank (not shown) and a fuel pump 114 for pumping fuel from the tank and delivering it to each combustion chamber 59. As known to those skilled in the art, the fuel may be delivered into the incoming air stream, such as with a carburetor or fuel injector, or directly injected into the combustion chamber with a fuel injector.

A throttle 116 is provided for controlling the flow of air into each combustion chamber 59. Preferably, the throttle 116 comprises a moveable plate positioned within the runner 78. The throttle 116 is preferably controlled through a cable by the operator of the watercraft 24.

A suitable ignition system is provided for igniting an air and fuel mixture within each combustion chamber 59. Such systems are well known to those skilled in the art, and as such forms no portion of the invention herein, such is not described in detail here.

The engine 22 includes a lubricating system for providing lubricant to the various portions of the engine. The lubricating system is not described in detail here, and may be of a variety of types found suitable to those skilled in the art. Generally, the lubricating system includes an oil reservoir 118 positioned below the engine 22. The reservoir 118 is defined by a wall 117 and is in communication with an oil pump 120 via a suction tube 119 having a valve 119*a* positioned therein. The oil pump 120 is preferably positioned on the end of the crankshaft 56 at the bottom of the engine 22. The oil pump 120 pumps lubricant from the reservoir 118 through oil passages throughout the engine 22. The pumped oil drains from the engine 22 back to the reservoir 118 for recirculation by the pump 120.

Preferably an oil temperature sensor 123 is provided along a main oil gallery passage for measuring the temperature of the oil passing therethrough. An output signal is provided by the sensor 123 which is transmitted to an electronic control unit (ECU) 190 described in more detail below.

Figure 6:
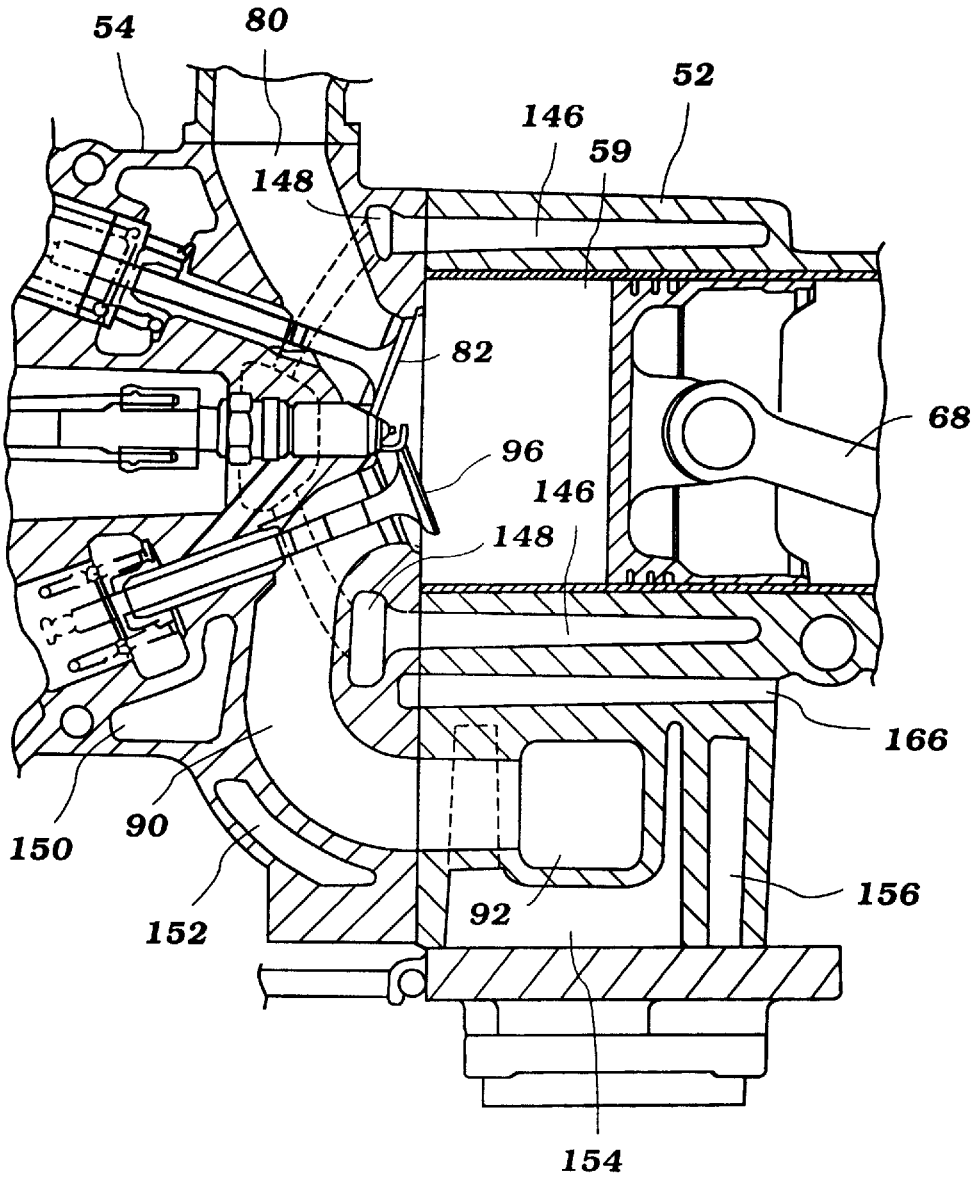
FIG. 6 is a partial cross-sectional view of a cylinder block, head and exhaust manifold of the engine illustrated in FIG. 2, having a cooling arrangement in accordance with a first embodiment of the present invention.
Figure 8:
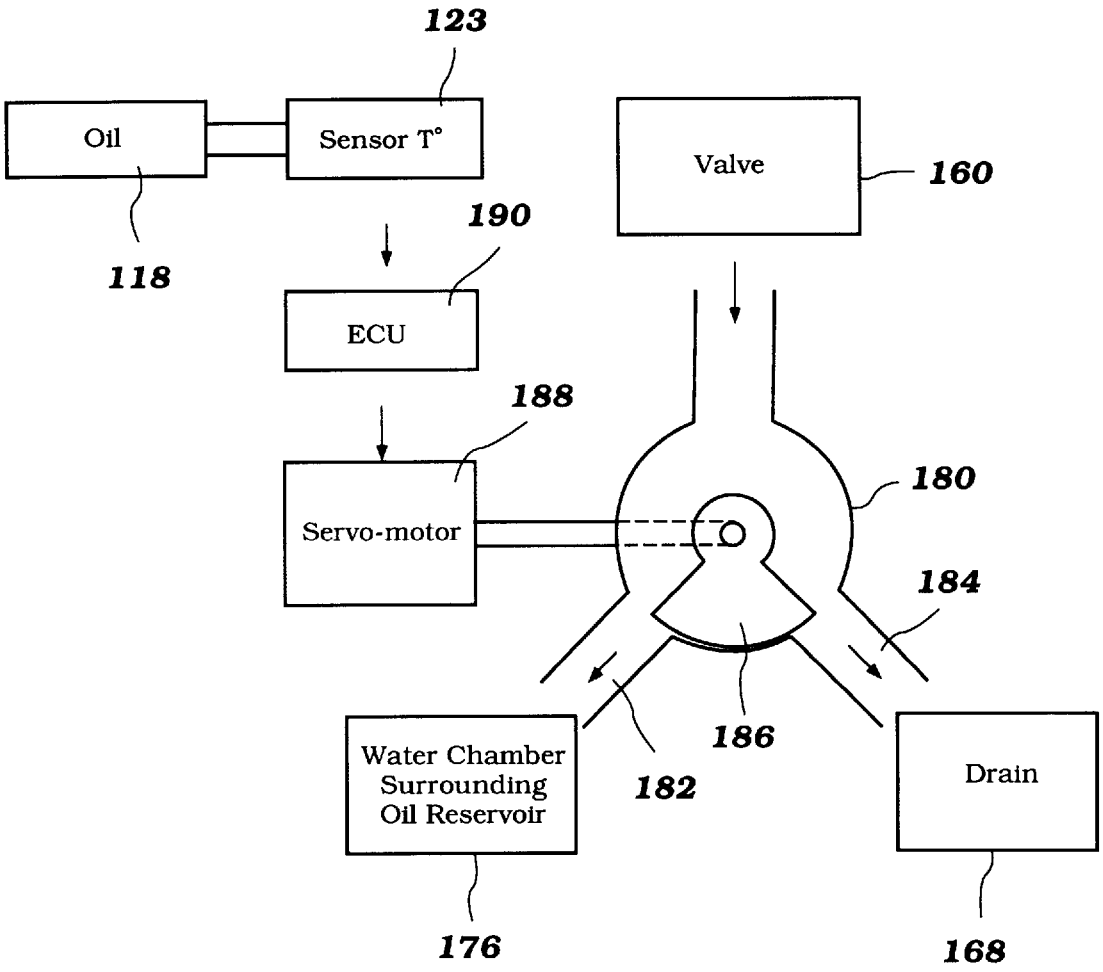
FIG. 8 is schematic illustrating a cooling liquid diverter mechanism in accordance with the present invention.

As illustrated in more detail in FIGS. 6 and 8, the exhaust manifold is preferably formed integrally with the cylinder block 52. In this arrangement, the exhaust passage 92 is simply a passage extending generally vertically through an extended portion of the cylinder block 52.

Figure 4:
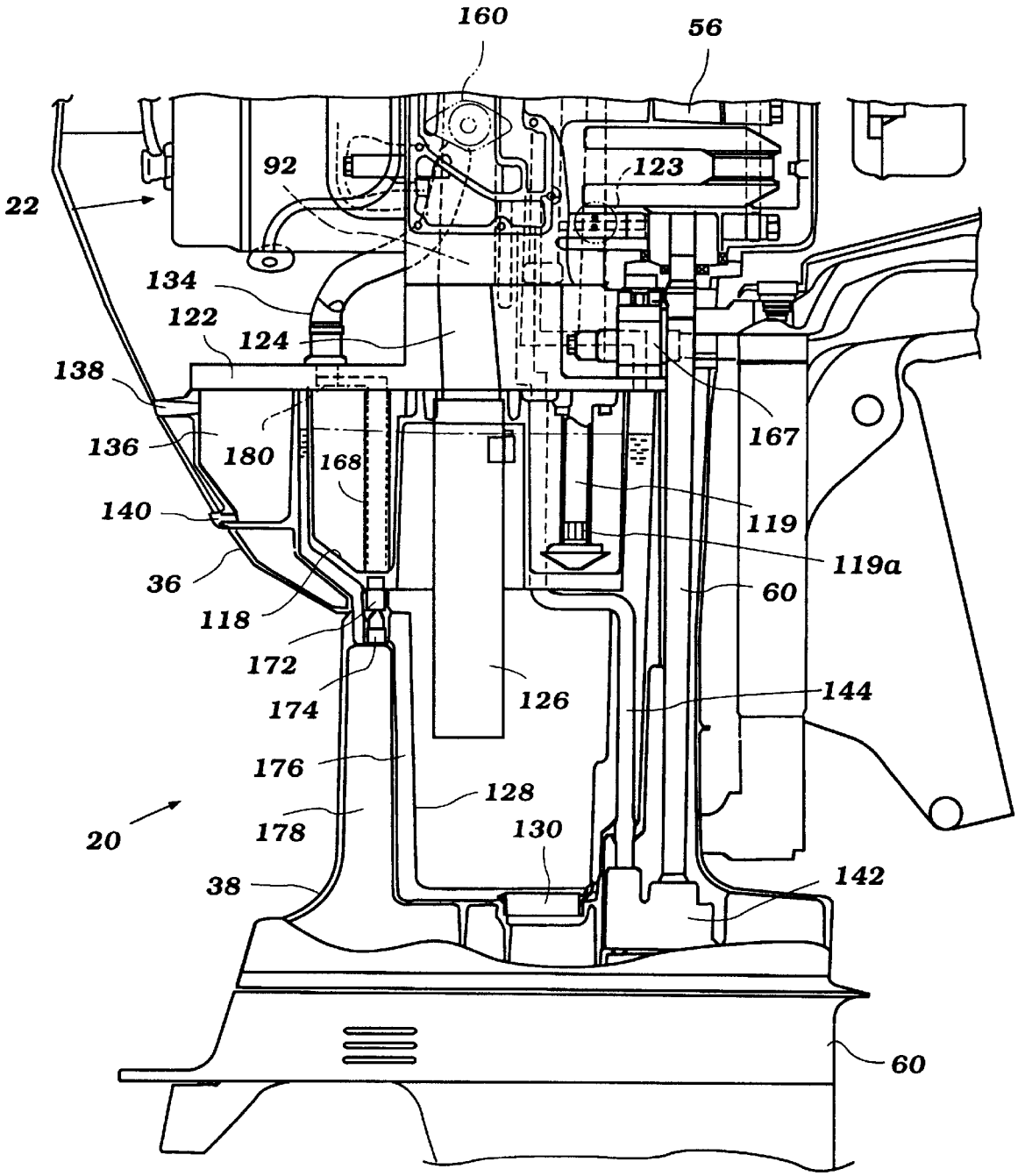
FIG. 4 is an enlarged view of a lower portion of the engine illustrated in FIG. 2 and motor components related thereto.

As best illustrated in FIG. 4, an exhaust guide 122 is positioned at the bottom end of the engine 22. The exhaust guide 122 has a passage 124 extending therethrough which is aligned with the passage 92 at its top side. An exhaust pipe 126 is connected to the bottom side of the exhaust guide 122 in alignment with the passage 124. The exhaust pipe 126 terminates within a chamber formed within a muffler 128.

The muffler 128 is positioned within the lower unit 38 and between the drive shaft 60 and a cooling liquid return. An exhaust gas outlet 130 is provided in the bottom end of the muffler 128, through which the exhaust gas is routed to a point external of the motor 20, normally through a passage extending through the hub 62 of the propeller 64.

When the exhaust pressure is low, normally when the engine speed is low, the exhaust gas is diverted to an above-water exhaust gas discharge. In the embodiment illustrated in FIG. 2, this discharge comprises an expansion chamber 136 and first and second exhaust ports 138,140. The exhaust ports 138,140 extend through the apron 36 from the chamber 136 for exhausting gases therefrom. The lower exhaust port 140 is provided for use in allowing condensed liquids to drain from the chamber 136.

As illustrated in FIG. 6, a space 166 is provided between the common exhaust passage 92 and each combustion chamber 59 for reducing rate of heat transfer from exhaust gases flowing through the passage 92 to the combustion chambers 59. In the arrangement illustrated in FIG. 6, the space 166 is an elongate passage extending from the exterior of the cylinder block 52 inwardly therethrough to a mating portion in the cylinder head 54, are positioned within the block. Preferably, a space 166 is provided between the passage 92 and the cooling liquid jacket 146 surrounding each combustion chamber 59.

In accordance with the present invention, the engine 22 includes an improved liquid cooling system. First, cooling liquid, preferably cooling water from the body of water in which the motor 22 is positioned, is pumped by a pump 142 positioned in the lower unit 34. The pump 142 is preferably driven by the drive shaft 60, and expels the cooling liquid or water upwardly through a cooling liquid pipe 144. This cooling liquid passes into a number of cooling liquid passages throughout the cylinder block 52 and head 54. As best illustrated in FIGS. 6–8, these passages include a cooling liquid jacket 146 surrounding the combustion chambers 59 in communication with a similar cooling liquid jacket or passage 148 in the cylinder head 54. Cooling liquid passages 150,152 are further provided in the cylinder head 54 adjacent the exhaust valves 96 and exhaust passages 90. A cooling liquid passage 154 is preferably provided in the manifold portion 94 of the cylinder block 52 on a side of the exhaust passage 92 defined therein opposite the combustion chambers 59. All of the cooling liquid passages lead to a cooling liquid outlet passage 156. Preferably, the cooling liquid flows first through passage 154 and then passages 150,152, before flowing to the passages 146,148 surrounding the combustion chamber 59.

The cooling system preferably includes a thermostat 158 for controlling the flow of cooling liquid through the various cooling liquid passages. In particular, the thermostat 158 is arranged at the top end of the engine 22 for controlling the flow of cooling liquid through the engine 22 to the outlet passage 156. In particular, the thermostat 158 prevents the cooling liquid from flowing through the engine 22 when the temperature of the cooling liquid therein is below a predetermined temperature, thereby allowing the engine to warm up.

In addition, a cooling liquid pressure relief valve 160 is provided. This valve 160 is preferably in communication with the cooling liquid passage 154, and has a relief line 134 extending therefrom. In the instance where the cooling liquid pressure within the cooling passages exceeds a predetermined pressure, the pressure relief valve 160 opens, allowing cooling liquid to flow through the line 134 to either an overflow pipe 168 or a cooling liquid pool or chamber 176, as described in more detail below.

A cooling water tell-tale is provided, allowing the operator of the watercraft 24 to visually determine that cooling liquid is being provided to the engine 22. In particular, a pilot line 162 extends from one of the cooling liquid passages to a port 164. The port 164 is positioned above the water line, such that a small amount of cooling liquid is expelled therefrom 164 as a visual identifier to the operator that cooling liquid is being provided to the engine.

Cooling liquid which circulates through the engine 22 to the outlet passage 156 (when the thermostat 158 is open) passes downwardly through a cooling liquid discharge pipe 167 into a chamber 176 which extends at least partially around the oil tank 118, muffler 128 and other components. An overflow pipe 168 has its top end positioned in the chamber 176, and extends to first and second passages 172,174 leading to a discharge tank 178, before passing out of the motor 20 back to the body of water from which it was drawn.

As illustrated in FIGS. 7–10, means are provided for diverting cooling liquid which passes through the pressure relief valve 160 into the relief line 134 to either the chamber 176 surrounding the oil reservoir 118, or through the pipe 168 to the discharge tank 178. Preferably, this system includes a diverter 180. The diverter 180 is positioned at the end of the line 134 and has a first outlet in communication with a passage 182 leading to the chamber 176 adjacent the oil reservoir 118, and a second passage 184 leading to the pipe 168.

Figure 9:
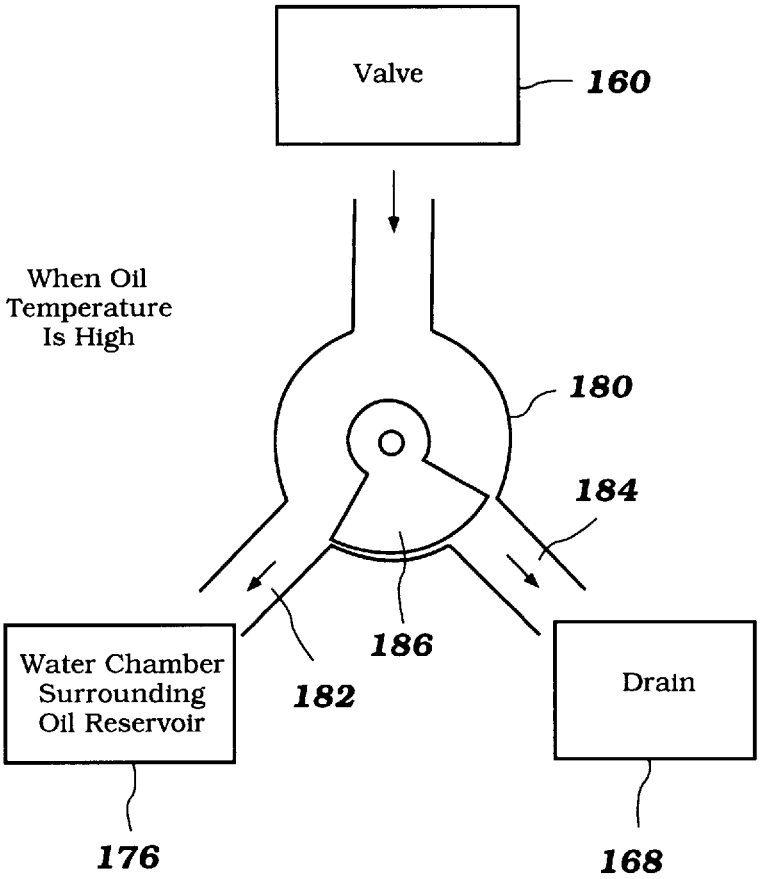
FIG. 9 is a schematic illustrating a first position of the diverter illustrated in FIG. 8.
Figure 10:
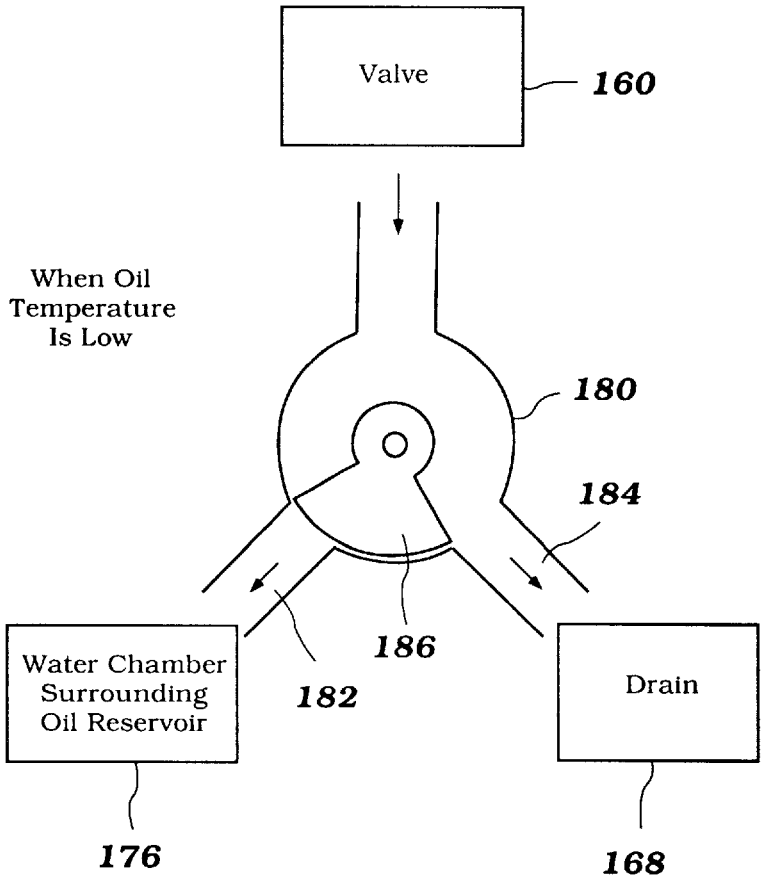
FIG. 10 is a schematic illustrating a second position of the diverter illustrated in FIG. 8.

The diverter 180 has a diverter valve member 186 which is preferably movable between first and second positions by a servo-motor 188. In a first position, as illustrated in FIG. 9, the member 186 obscures the passage 184, but leaves open the passage 182, so that all cooling liquid passing into the diverter 180 is diverted into the chamber 176. In a second position, as illustrated in FIG. 10, the member 186 obscures the passage 182 but leaves open the passage 184, so that all cooling liquid passing into the diverter 180 is diverted directly to the pipe 168 and to the discharge tank 178.

Preferably, the diverter 180 is moved to its first position, as illustrated in FIG. 9, when the ECU 190 receives a signal from the oil temperature sensor 123 that the oil temperature is above a predetermined high temperature. In that instance, the ECU 190 activates the servo-motor 188 to move the member 186 to obscure the passage 184. Alternatively, when the ECU 190 receives a signal indicating that the temperature of the oil is low, then the member 186 is moved to the position illustrated in FIG. 10.

Figure 11:
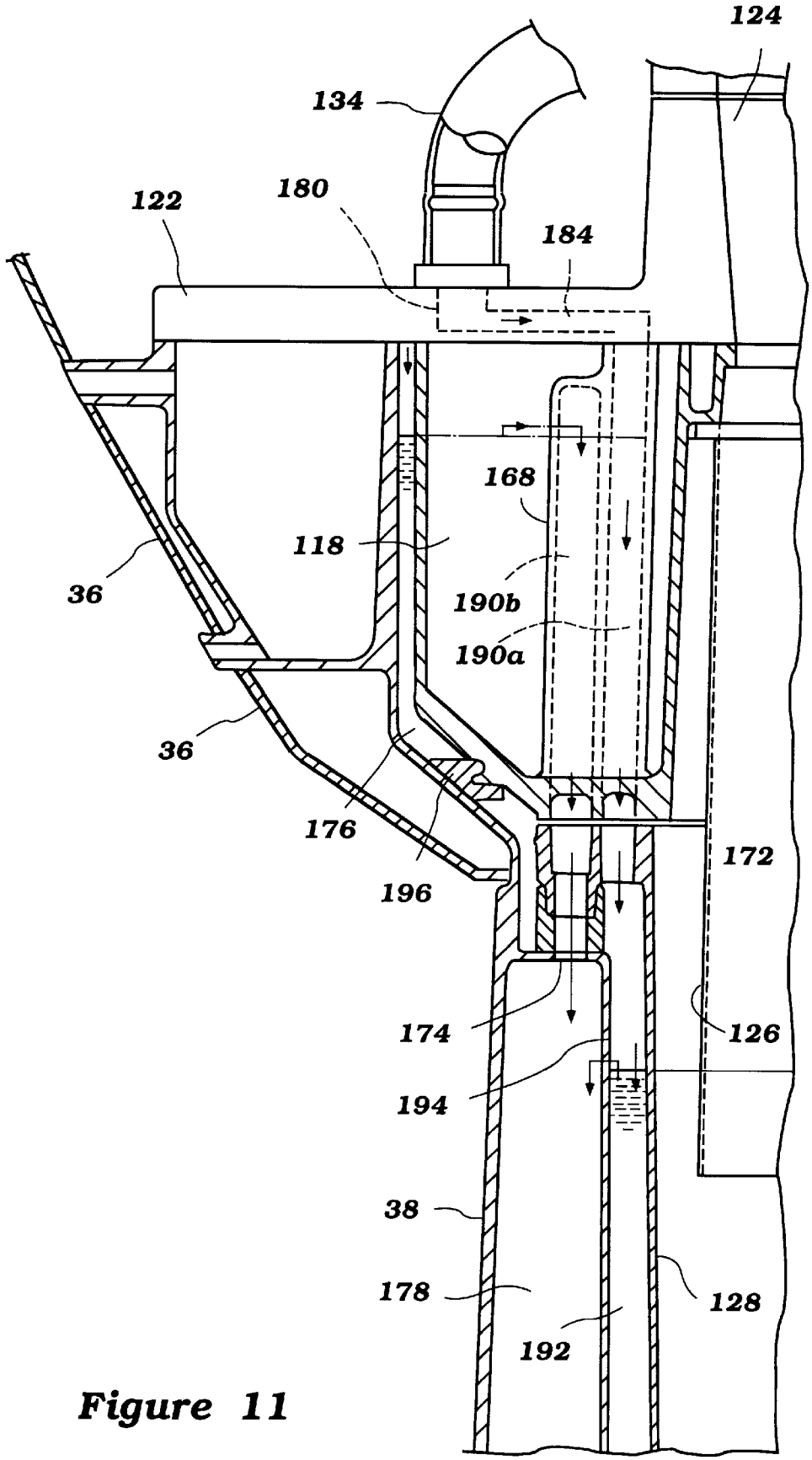
FIG. 11 is an enlarged, partial cross-sectional view of a lower portion of the motor illustrated in FIG. 1, illustrating an alternate embodiment cooling liquid pressure relief drain path in accordance with the present invention.

An alternative arrangement for diverting the cooling liquid passing through the pressure relief valve 160 and line 134 is illustrated in FIG. 11. As illustrated therein, all cooling liquid passing through the line 134 enters the passage 184 and then passes downwardly through a first passage 190*a* in the cooling liquid pipe 168 to a coolant pool chamber 192 which extends about at least a portion of the muffler 128. Notably, in this arrangement one pool (176) extends about the oil reservoir 118, and the second pool (192) extends about the muffler 126. A divider 196 is positioned within chamber 176 between an outer wall and the oil reservoir 118 for keeping the cooling liquid in that portion of the chamber 176 surrounding the oil reservoir 118 separate from that in the second pool 192.

Once the second chamber 192 is filled to a predetermined height with cooling liquid, the cooling liquid overflows through an opening 194 into the discharge tank 178. The cooling liquid which fills the chamber 176 via the normal engine cooling liquid discharge eventually overflows through an overflow into a second passage 190*b* in the pipe 168 to the discharge tank 178.

The above-described engine cooling system has several advantages. First, while the engine is warming up, the thermostat 158 is closed, preventing the flow of cooling liquid through the engine 22. At this same time, the pressure relief valve 160 will open as the pressure of the cooling liquid rises. This cooling liquid is diverted to a drain or other location away from the cooling liquid chamber 176 surrounding the oil reservoir 118. This arrangement also thus allows the lubricating oil in the reservoir 118 to warm up as well.

When the engine heats up, the thermostat 158 opens, allowing cooling liquid therethrough to cool the engine 22. At the same time, if the pressure of the cooling liquid in the engine 22 becomes too high, cooling liquid passes through the pressure relief valve 160. If the oil temperature is indicated as high, this cooling liquid passes into the cooling liquid chamber 176 surrounding the oil reservoir 118 for cooling the oil therein. If the oil temperature is still indicated as low, the cooling liquid is still preferably routed away from the cooling liquid chamber 176 surrounding the oil reservoir 118.

Yet another arrangement of the present invention for an engine is illustrated in FIGS. 12–16. These figures illustrate the cooling arrangement of the present invention as adapted to a "V"-type engine for powering a motor 20 similar to that illustrated in FIG. 1.

As illustrated in FIGS. 12–20 there is provided a "V"-type engine 222 having six combustion chambers 259. The engine 222 may have a greater or lesser number of combustion chambers, such as two, four, or eight or more.

Figure 13:
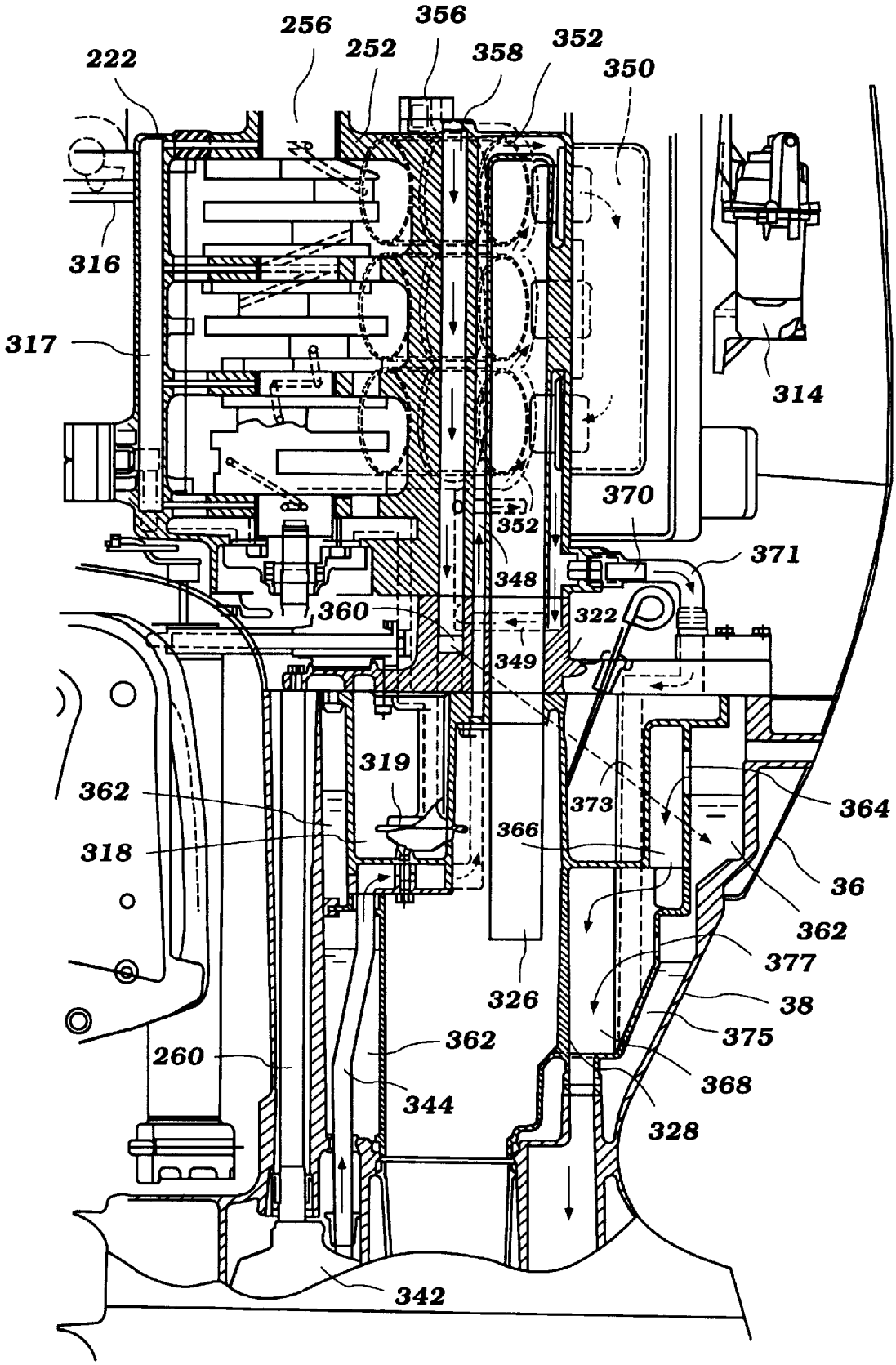
FIG. 13 is an enlarged, partial cross-sectional side view of the motor powered by the engine illustrated in FIG. 12 and having a first embodiment engine cooling arrangement.
Figure 14:
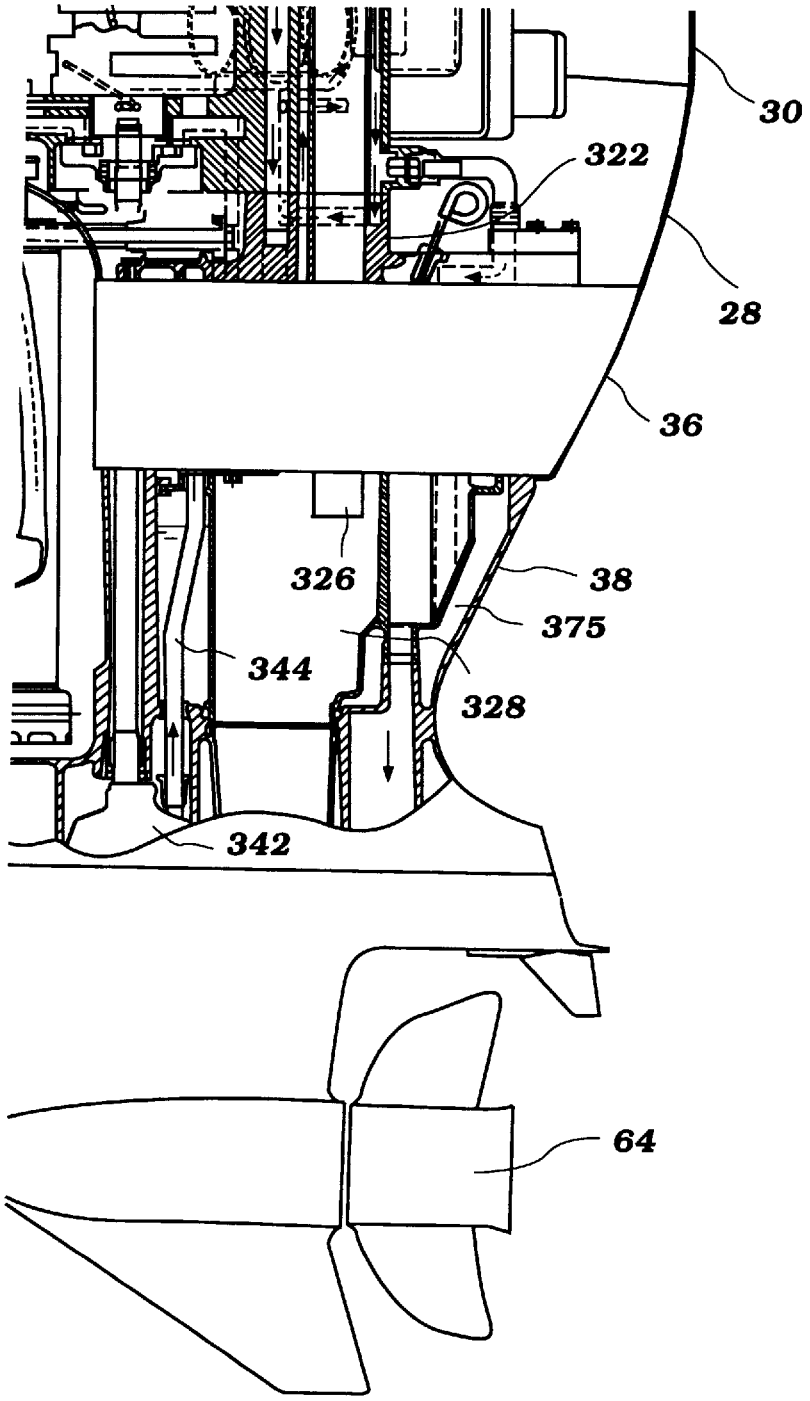
FIG. 14 is yet another cross-sectional view illustrating a portion of the motor illustrated in FIG. 12.

As best illustrated in FIG. 13, the engine 222 has a cylinder block 252 with a first cylinder head 254*a* and a second cylinder head 254*b* connected thereto, defining first and second cylinder banks. Each bank of cylinders preferably defines three combustion chambers 259.

A piston 266 is movably positioned in each combustion chamber 259. Each piston 266 is connected to a connecting rod 268 extending to a vertically extending crankshaft 256. The crankshaft 256 is arranged to drive a propeller in a manner similar to that described above.

The crankshaft 256 is journalled for rotation with respect to the cylinder block 252. A crankcase cover 253 engages an end of the block 252, defining therewith a crankcase chamber 257 within which the crankshaft rotates.

Figure 12:
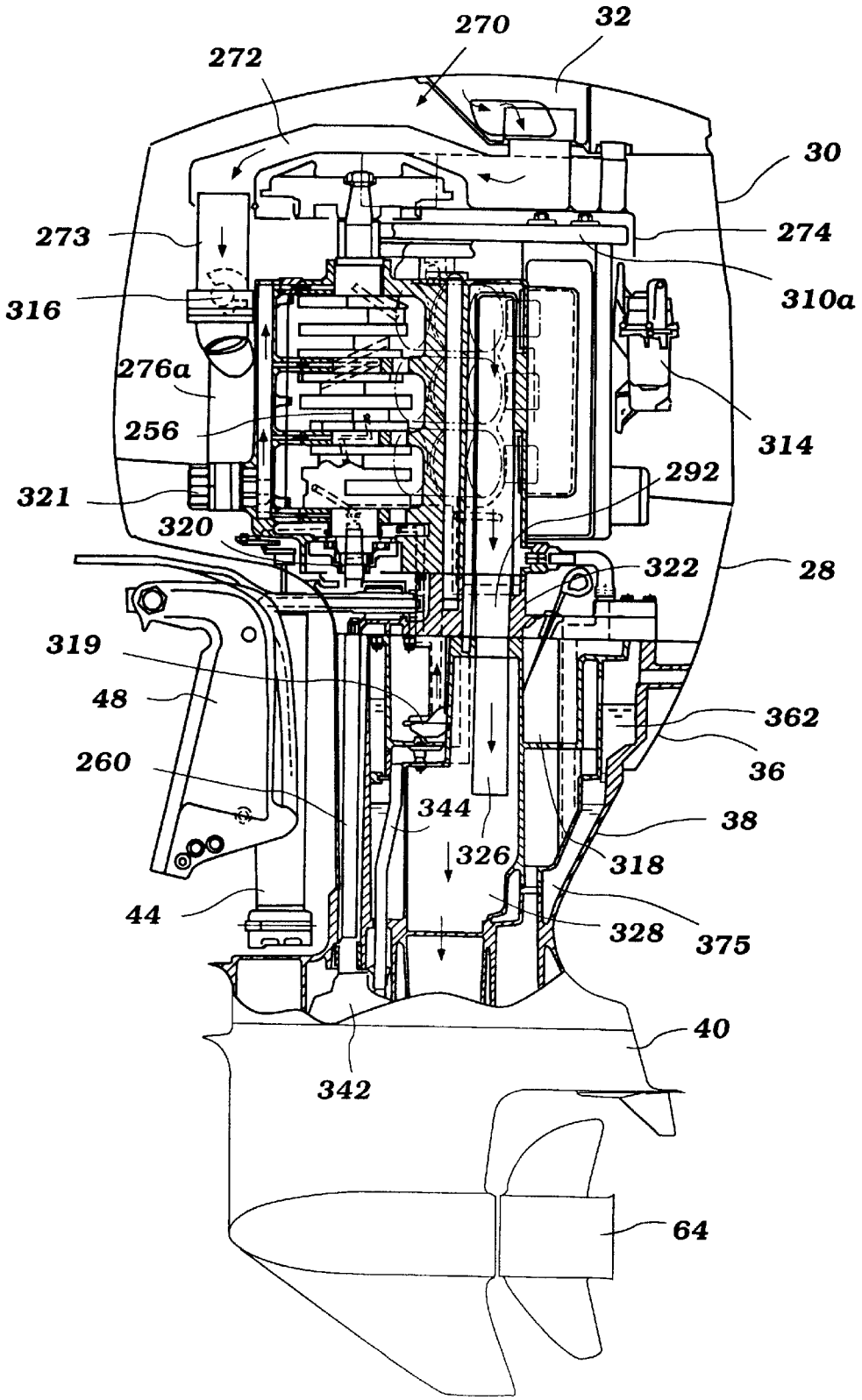
FIG. 12 is a side view, in partial cross-section illustrating an internal combustion engine of the "V"-type having an exhaust manifold cooling arrangement in accordance with the present invention for use in powering a motor similar to that illustrated in FIG. 1.

As with the engine 22 described above and as illustrated in FIGS. 12, 16 and 18, the engine 222 includes an air intake system 270 for providing air to each combustion chamber 259. As illustrated in FIG. 12, air passes through the vent 32 in the motor cowling 30 and through an air plenum 272 to a main intake pipe 273. As illustrated, this air plenum 272 is positioned above a flywheel cover 274. The pipe 273, in turn, branches to first and second surge tanks 276*a,b* having branches 277 extending therefrom. Preferably, each surge tank 276*a,b* has a three branches 277 extending therefrom, one for each combustion chamber 259 in a bank.

Each branch 277 extends to a passage 278 through an intake manifold 279. This passage 278 extends through an intake passage 280 in the cylinder head 254*a,b* to its respective combustion chamber 259.

Means are provided for controlling the flow of air into each combustion chamber 259. Preferably, this means comprises an intake valve 282 corresponding to each intake passage 280. As illustrated, all of the intake valves 282 for each bank of cylinders are preferably actuated by a single intake camshaft 284. The intake camshaft 84 is mounted for rotation with respect to the head 254 and connected thereto with at least one bracket. The camshafts 284 are enclosed by a camshaft cover 288 which is connected to the respective head 254*a,b*.

An exhaust system is provided for routing the products of combustion within the combustion chambers 259 to a point external to the engine 222. In particular, an exhaust passage 290 leads from each combustion chamber to a passage 292 in an exhaust manifold portion 294 of the engine 222. The remainder of the exhaust system will be described in more detail below.

Means are also provided for controlling the flow of exhaust from each combustion chamber 259 to its respective exhaust passage 290. Preferably, this means comprises an exhaust valve 296. Like the intake valves 282, the exhaust valves 296 of each cylinder bank are preferably all actuated by a single exhaust camshaft 298. Each exhaust camshaft 298 is journalled for rotation with respect to its respective cylinder head 254*a,b* and connected thereto with at least one bracket. Each exhaust camshaft 298 is enclosed within the camshaft cover 288.

As best illustrated in FIGS. 12–15 and 20, means are provided for driving the camshafts 284,298. A timing belt pulley 302 is mounted on a top end of the crankshaft 256 positioned outside of the cylinder block 252, and just below a flywheel 304 also positioned on the crankshaft 256. An exhaust camshaft pulley 306 is mounted on an end of each exhaust camshaft 298 extending from the top end of the engine 222, and an intake camshaft pulley 308 is mounted on an end of each intake camshaft 284 extending from the top end of the engine. A first drive belt 310*a* extends around the timing belt pulley 302 and the exhaust and intake camshaft pulleys 206,208, corresponding to a first cylinder bank, and a second drive belt 310*b* extends around the timing belt pulley 302 and the exhaust and intake camshaft pulleys 206,208 of the other cylinder bank. By this arrangement, the camshaft 256 indirectly drives the camshafts 284,298. One or more tensioner pulleys (not shown) may be provided for maintaining the belt in a taunt condition.

A fuel delivery system is provided for delivering fuel to each combustion chamber 259 for combustion therein. The fuel delivery system preferably includes a fuel tank (not shown) and a fuel pump (not shown) for pumping fuel from the tank and delivering it to each combustion chamber 259. A vapor separator 314 may be included in the fuel system, and preferably, the fuel is injected into the air stream flowing through each air intake branch 277 with a fuel injector 315.

A throttle 316 is provided for controlling the flow of air into the combustion chambers 259. Preferably, the throttle 316 comprises a moveable plate positioned within air intake pipe 273. The throttle 316 is preferably controlled through a cable by the operator of the watercraft 24.

A suitable ignition system is provided for igniting an air and fuel mixture within each combustion chamber 259. Such systems are well known to those skilled in the art, and as such forms no portion of the invention herein, such is not described in detail here.

The engine 222 includes a lubricating system for providing lubricant to the various portions of the engine. The lubricating system is not described in detail here, and may be of a variety of types found to those skilled in the art. Generally, the lubricating system includes an oil reservoir 318 positioned below the engine 222. The reservoir 318 is in communication with an oil pump 320 via a suction tube 319. The oil pump may be positioned on the end of the crankshaft 256 at the bottom of the engine 222. The oil pump pumps lubricant from the reservoir 318 through an oil filter 321, and on to oil passages, such as a main gallery 317 throughout the engine 222. The pumped oil drains from the engine 222 back to the reservoir 318 for recirculation by the pump.

Figure 16:
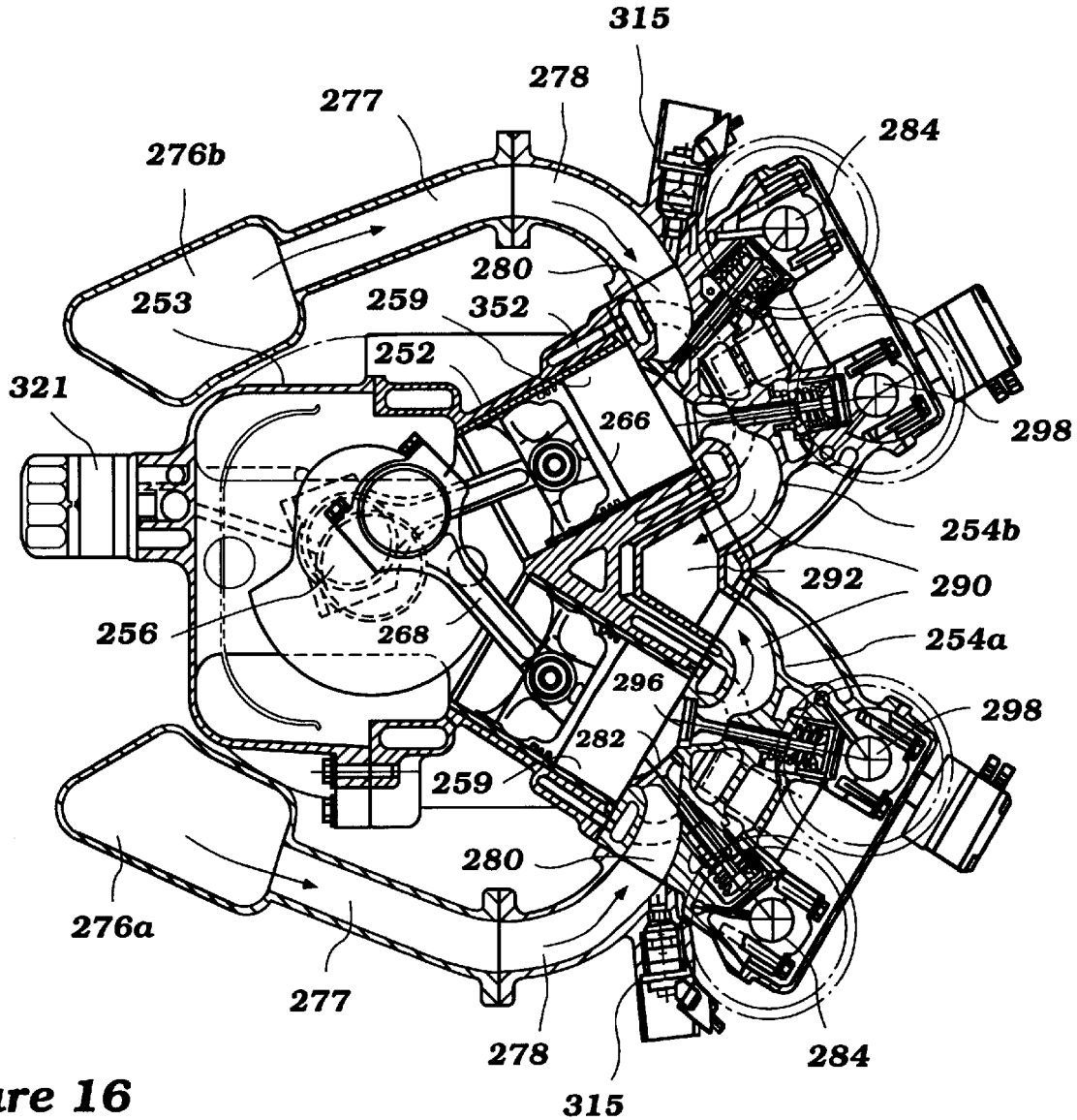
FIG. 16 is a top, cross-sectional view of the engine illustrated in FIG. 12.
Figure 17:
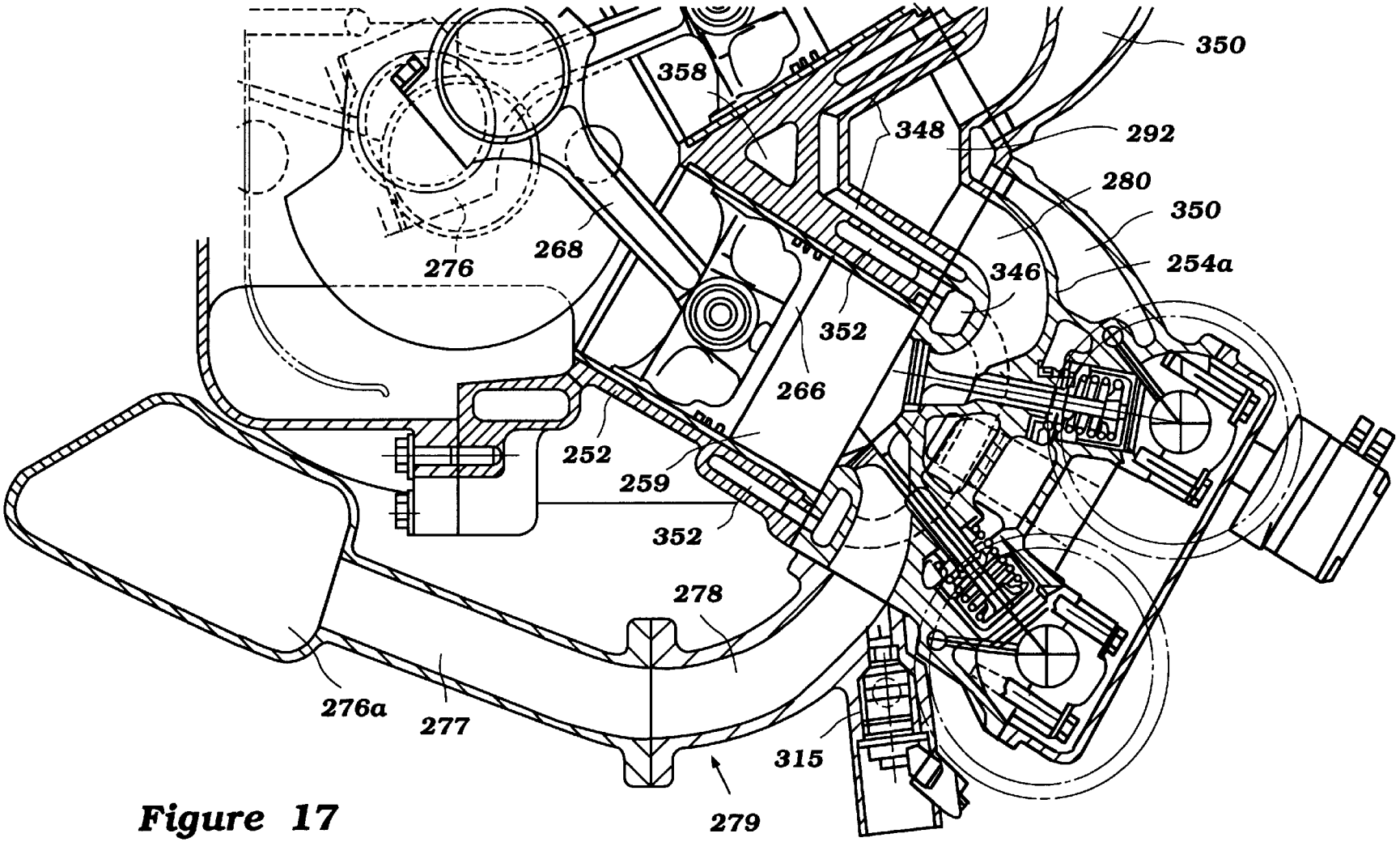
FIG. 17 is an enlarged view of that portion of the engine illustrating the cooling arrangement for the exhaust manifold of the engine illustrated in FIG. 13.
Figure 18:
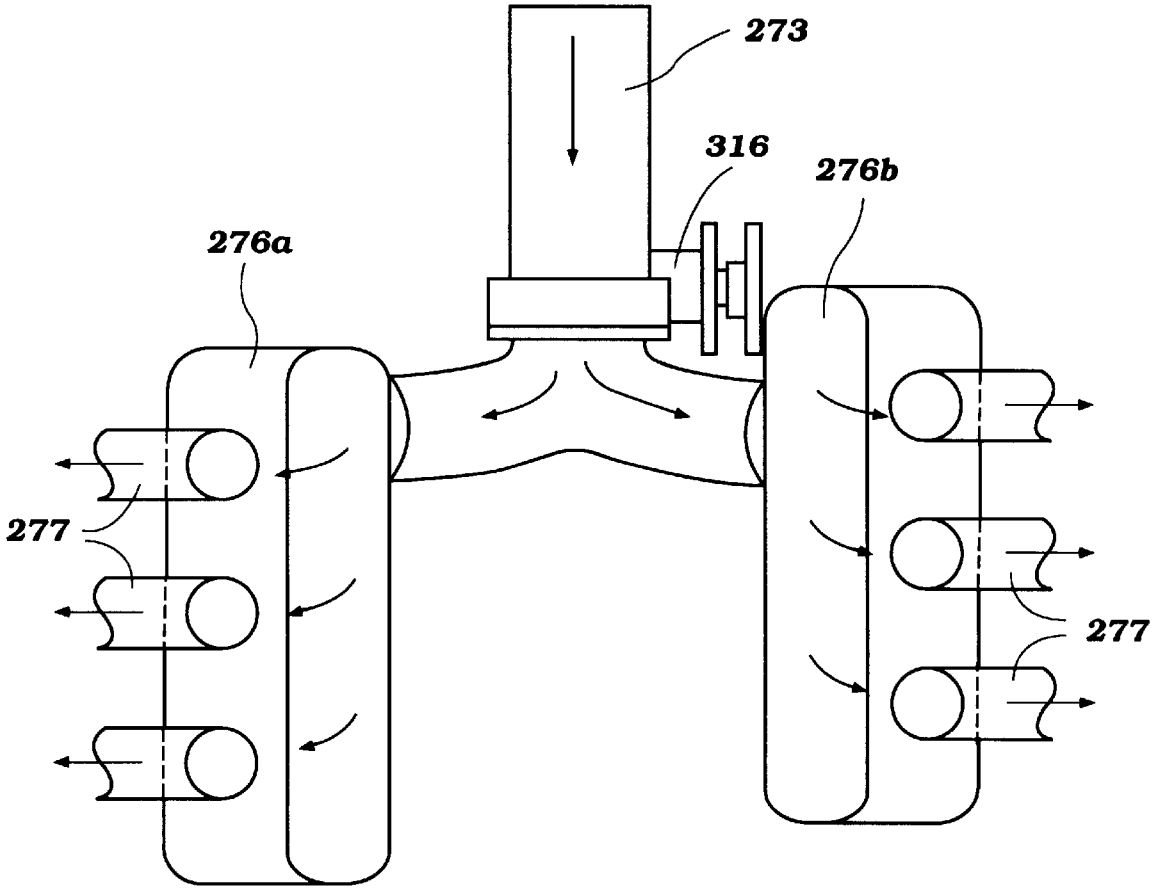
FIG. 18 is a schematic view illustrating the air intake system of the engine illustrated in FIG. 12.

As illustrated in more detail in FIGS. 16 and 17, the exhaust manifold is preferably formed integrally with the cylinder block 252. In this arrangement, the common exhaust passage 292 is simply a passage extending generally vertically through a portion of the cylinder block 252 located in the valley between the cylinder banks.

As best illustrated in FIG. 13, an exhaust guide 322 is positioned at the bottom end of the engine 222. The exhaust guide 322 has a passage 324 extending therethrough which is aligned with the passage 292 at its top side. An exhaust pipe 326 is connected to the bottom side of the exhaust guide 322 in alignment with the passage 324. The exhaust pipe 326 terminates within a chamber formed within a muffler 328.

The muffler 328 is positioned within the lower unit 38 and between the drive shaft 260 and a cooling liquid return. An exhaust gas outlet 330 is provided in the bottom end of the muffler 328, through which the exhaust gas is routed to a point external of the motor 20.

A cooling system is provided for cooling the engine 222. More particularly, and in accordance with the present invention, the cooling system serves to cool the exhaust manifold area 294 of the engine, to prevent the transmission of heat from the exhausted gases through the walls defining the passage 292 to the combustion chambers 259 to cool the lubricating oil, and is arranged to allow the oil and engine to warm up, as necessary. A schematic of the cooling system is set forth in FIG. 19.

Cooling liquid, preferably in the form of water from the body of water in which the motor 222 is positioned, is pumped by a water pump 342 positioned in the lower unit 34. The pump 342 is preferably driven by the drive shaft 260, and expels the cooling liquid upwardly through a cooling liquid pipe 344. This cooling liquid passes into a number of cooling liquid passages throughout the cylinder block 252 and heads 254*a,b*. As best illustrated in FIGS. 16 and 17, the pipe 344 leads to a generally "V" shaped passage 348 positioned between the common exhaust passage 292 and the combustion chambers 292 in each bank. After passing through passage 348, the cooling liquid is diverted into a pair of passages 350, one passage 350 each positioned in one of the cylinder heads 254*a,b* adjacent the exhaust passages 290 therethrough.

Figure 19:
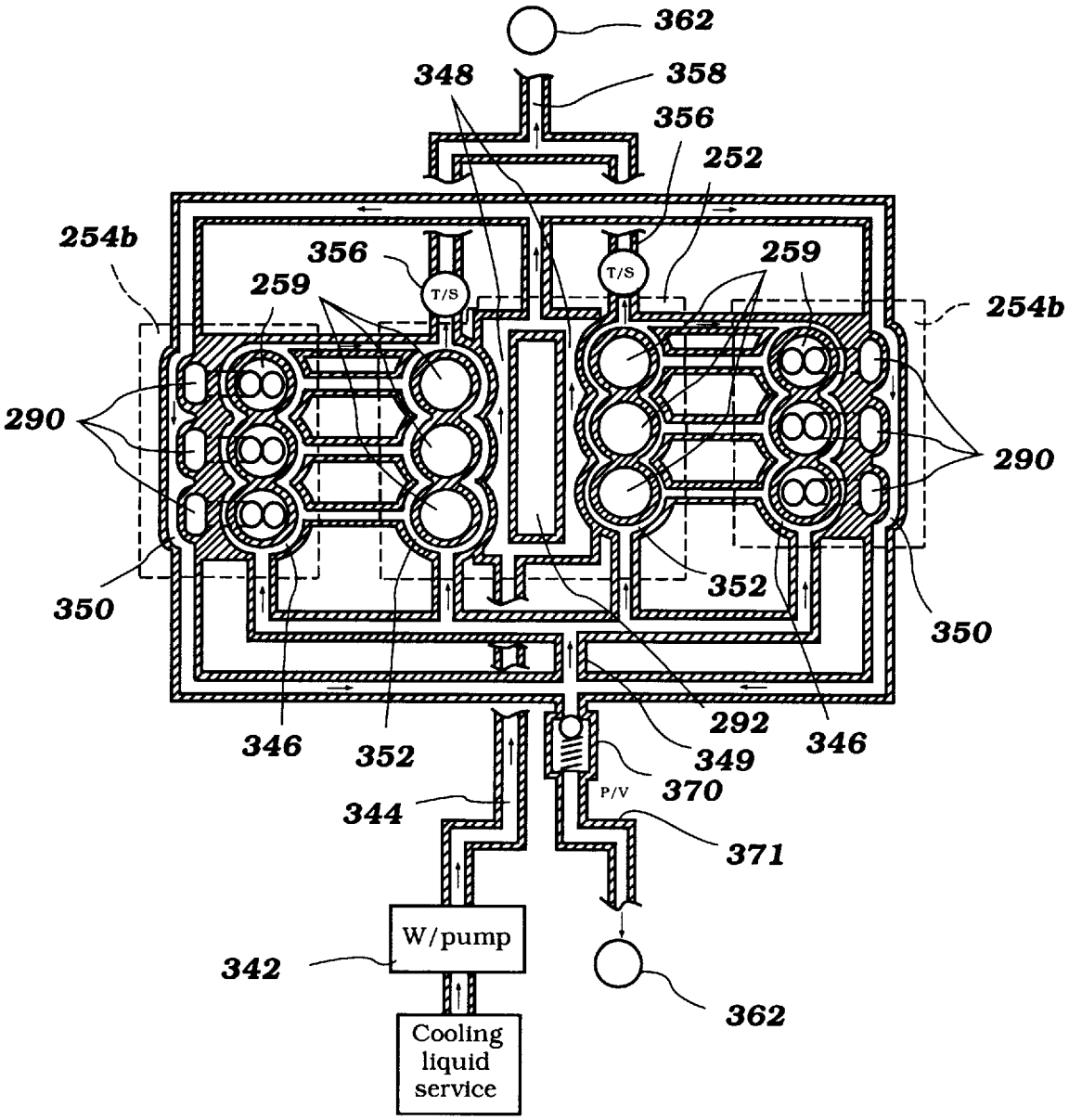
FIG. 19 is a schematic view illustrating a liquid cooling system in accordance with the present invention of the engine illustrated in FIG. 12.

As best illustrated in FIG. 19, the cooling liquid passages 350 rejoin at a passage 349 where there is positioned a pressure relief valve 370, described in more detail below. The cooling liquid which is not diverted by the valve 370 passes into passages 346 in each cylinder head 254*a,b* adjacent the combustion chambers 259, as well as passages 352 (in communication with passages 346) in the cylinder block 252 about the combustion chambers. Notably, the passages 346,352 take the form of jackets which generally surround the respective portions of the combustion chambers 259 formed in the cylinder block 252 and heads 254*a,b*. Thereafter, the cooling liquid passes into a return passage 358 extending through the cylinder block 252 generally vertically, for draining the cooling liquid to the bottom of the engine 222. The drain passage 358 is preferably positioned between the passage 348 and the combustion chambers 259, in the valley between the cylinder banks.

A thermostat 356 is provided at the end of each passage 352 corresponding to each cylinder bank, (and at the top end of the engine) and before the cooling liquid enters the return passage 358 for controlling the flow of cooling liquid through the heads and block. The cooling liquid return passage 358 extends generally vertically through the block 252 to a connecting passage 360 which leads into the lower unit 34 to a cooling liquid pool or chamber 362. This chamber 362 extends about the muffler 328, oil reservoir 318 and the like. When the liquid level in the chamber 362 becomes to high, the cooling liquid runs over an overflow ledge 364 to a passage 366 leading to a drain 368. The cooling liquid diverted to the drain 368 is discharged from the motor.

In that instance where the pressure of the cooling liquid within the block and head 352,254 become too high, a pressure relief valve 370 diverts cooling liquid to a drain line 371 which extends through the exhaust guide to a line 373 which extends downwardly to a chamber 375. When the cooling liquid level in this chamber 375 becomes high, cooling liquid flows through an outlet 377 into the drain 368.

In this arrangement, when the temperature of the engine (and thus the cooling liquid therein) is low, the thermostats 358 close, preventing cooling liquid from flowing through the engine 222. The pressure relief valve 370 relieves the cooling liquid pressure in the engine 222, diverting cooling liquid to the chamber 375, and on to the drain 368.

Once the engine 222 is warmed up, the thermostats 358 open and cooling liquid is allowed to flow through the engine. If the cooling liquid pressure becomes too high, the pressure valve 370 opens and cooling liquid is diverted to the drain 368 via the chamber 375.

Figure 20:
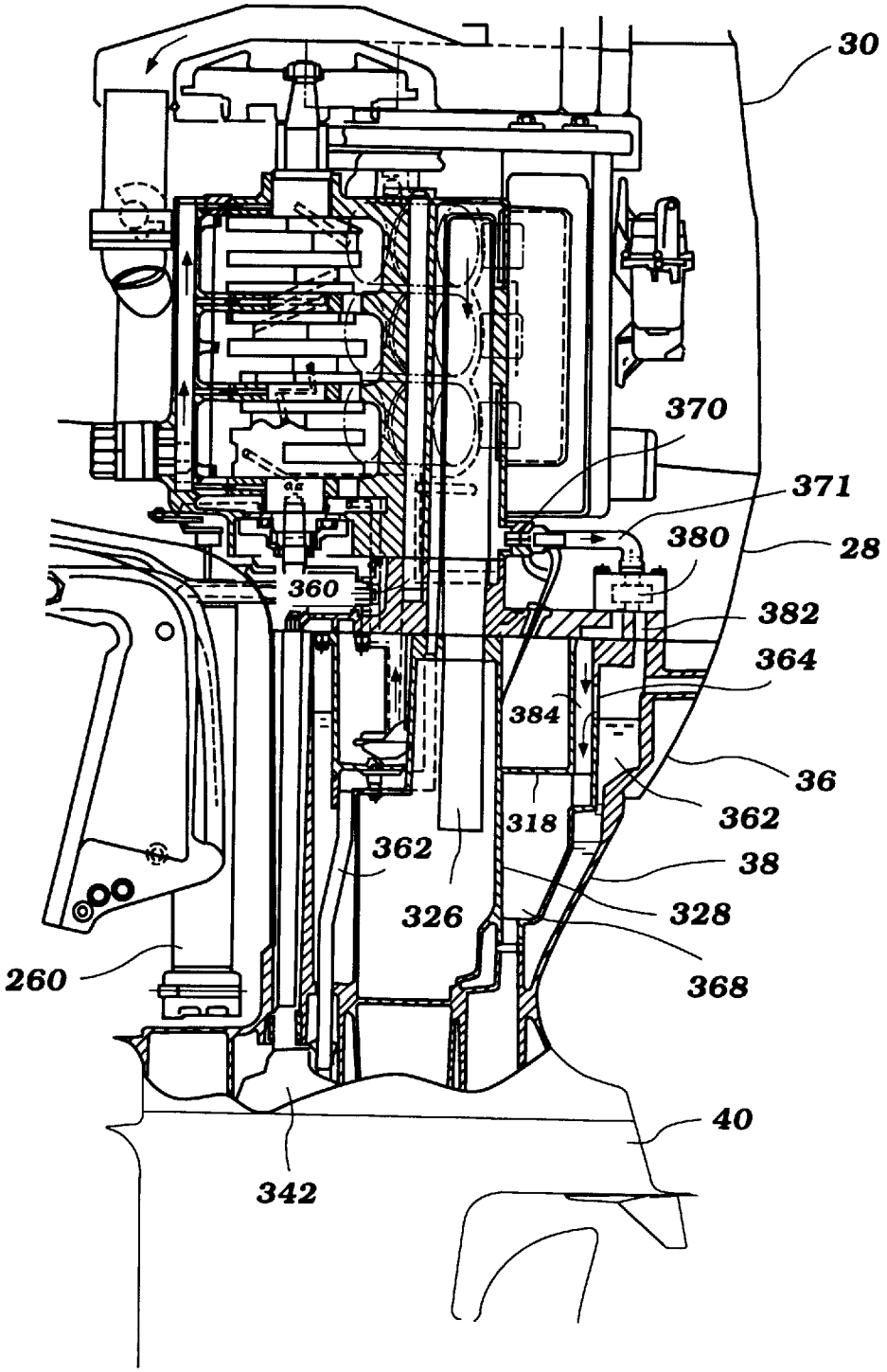
FIG. 20 is cross-sectional view of an engine similar to that illustrated in FIG. 12 and includes an alternate embodiment cooling system including a diverter for a cooling liquid pressure relief drain system.

More preferably, the cooling system for the engine 222 is arranged as illustrated in accordance with the embodiment cooling system illustrated in FIG. 20. As illustrated therein, the cooling liquid line 371 which extends from the pressure relief valve 370 leads to a diverter 380. First and second outlet lines or passages 382,384 extend through the exhaust guide 322 from the diverter 380. A first passage 382 extends to the cooling liquid chamber 362. The second passage 384 extends to a drain chamber 368 (as disclosed above in conjunction with the embodiment illustrated in FIG. 13) which is in communication with a cooling liquid outlet or drain for the motor 222. When the cooling liquid level within the chamber 362 becomes too high, the cooling liquid flows through an overflow 364 into the second passage 384, and thereon to the drain.

Figure 21:
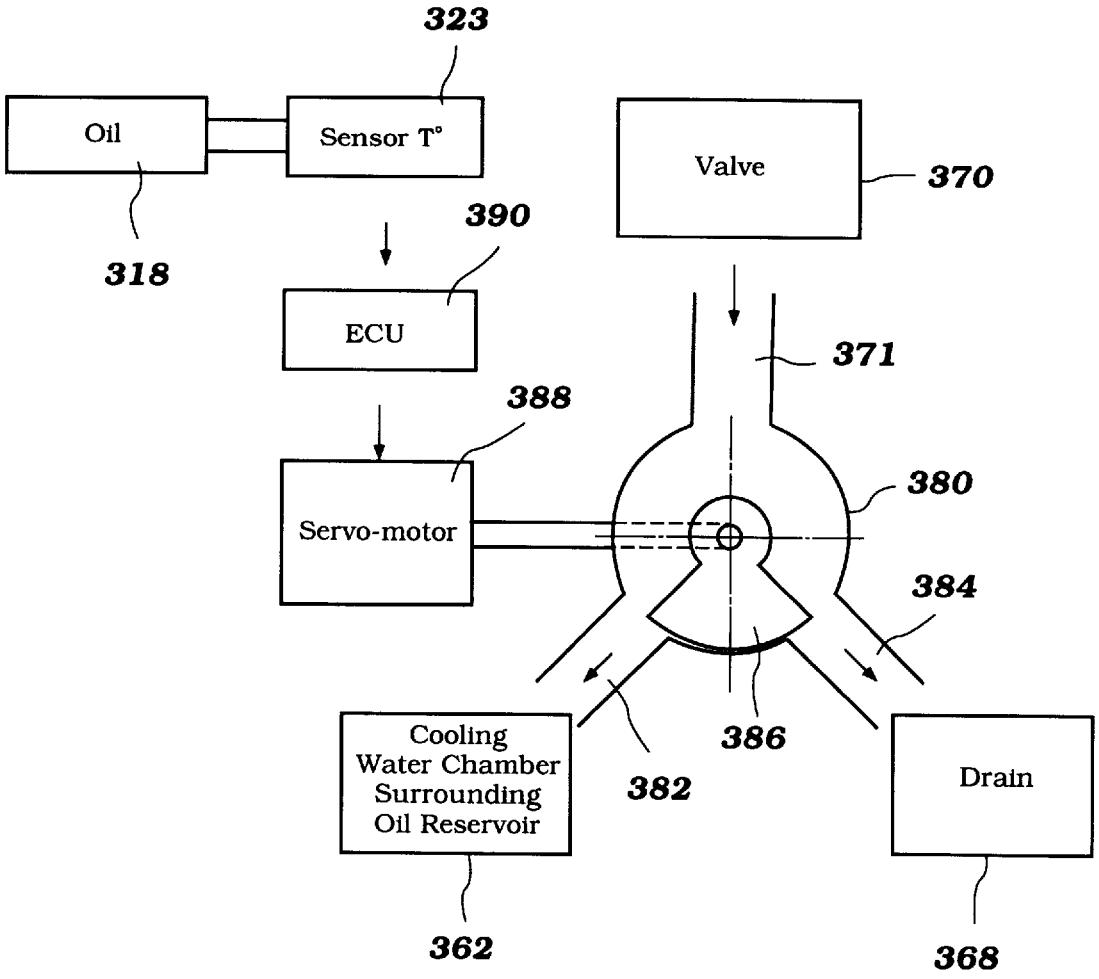
FIG. 21 is a schematic illustrating a cooling liquid diverter mechanism of the cooling system illustrated in FIG. 20.
Figure 22A:
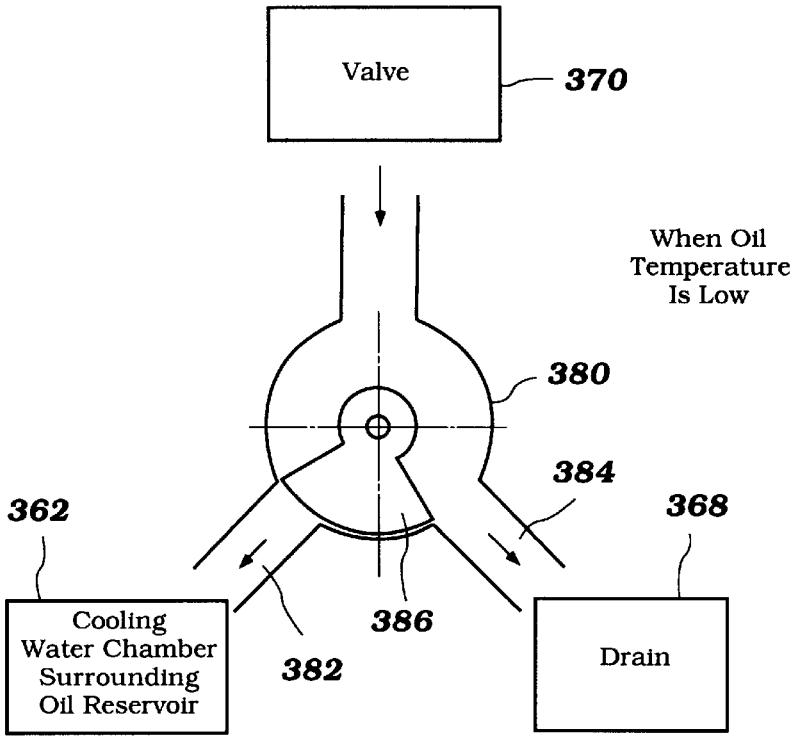
FIG. 22(*a*) is a schematic illustrating a first position of the diverter illustrated in FIG. 21.
Figure 22B:
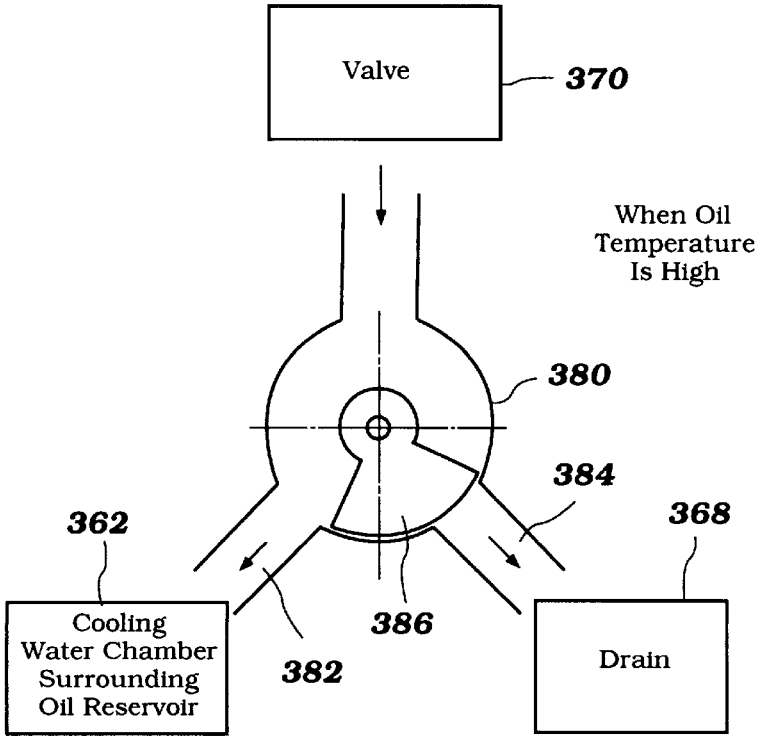

Preferably, means are provided for controlling the diverter 380 to control the flow of cooling liquid into the first and second passages 382,384. As illustrated in FIG. 21, this means preferably comprises an electronic control unit (ECU) 390 controlled servo-motor 388. The ECU 390 controls the servo-motor 388 to control the position of a diverter member 386 of the diverter 380. In particular, and as best illustrated in FIGS. 22(*a*) and (*b*), when ECU 390 receives a signal from the oil temperature sensor 323 indicating that the oil temperature is high, the ECU 390 instructs the servo-motor 388 to move the member 286 to a position in which it obstructs the second passage 384. In this position, the cooling liquid which is routed through the line 371 passes through the first passage 382 into the cooling liquid chamber 362 surrounding the oil reservoir 328 for cooling the oil therein. When the temperature sensor 323 indicates that the oil temperature is below a predetermined temperature, the ECU 390 instructs the motor 388 to move the diverter member 386 to a position in which it obstructs the first passage 382. In this position, all cooling liquid is diverted into the second passage 384 and directly to the cooling liquid drain.

Figure 15:
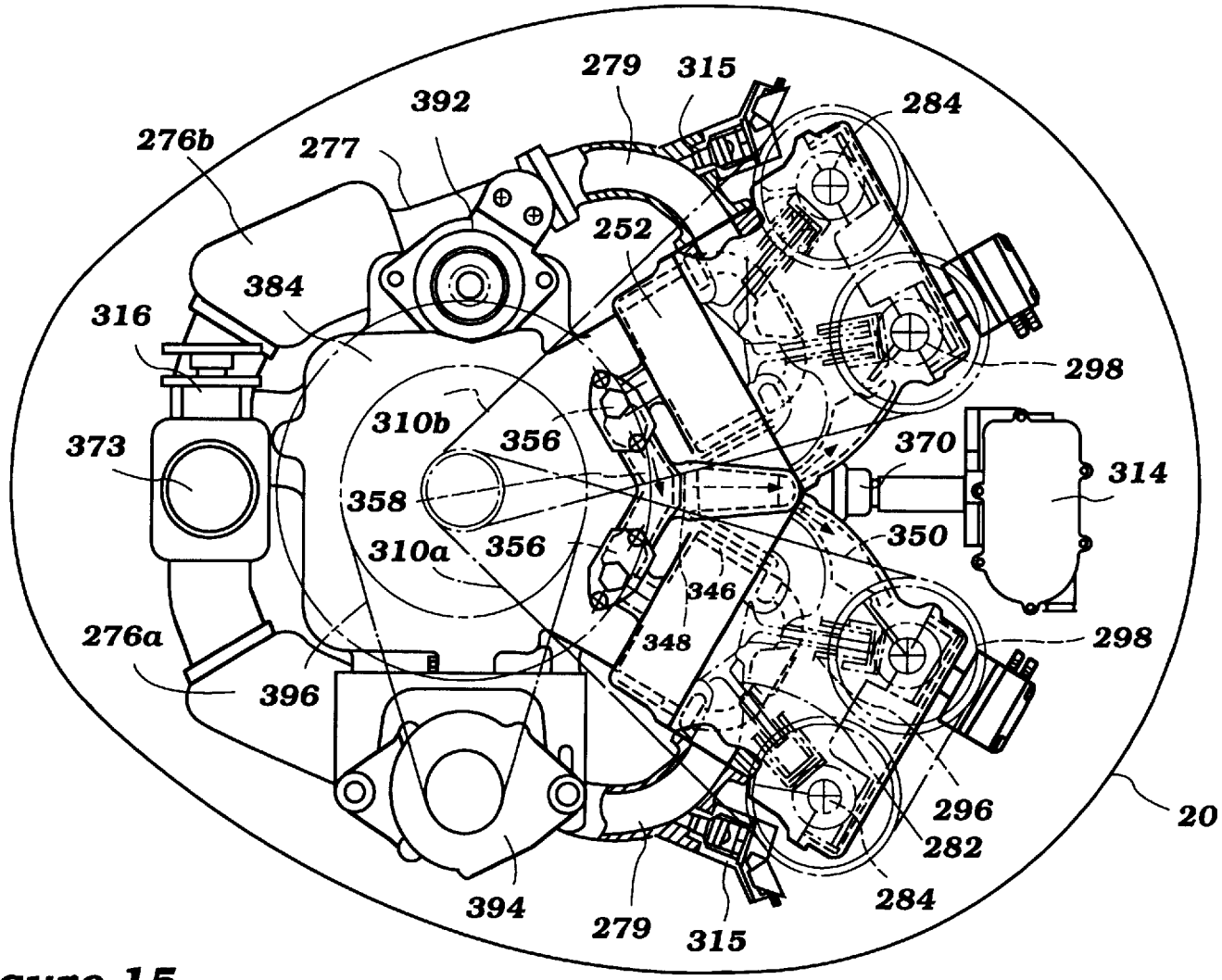
FIG. 15 is a top, partial cross-sectional view of the engine illustrated in FIG. 12.

As illustrated in FIG. 15, the engine 222 may also include a starter 392 which selectively engages the flywheel 304 for use in starting the engine. In addition, the engine 222 may include an alternator 394 which is driven by the crankshaft 256 by a belt 396. These and other engine accessories may be provided as well known to those skilled in the art.

In the above-described embodiments, it should be understood that the means for controlling the flow of coolant from the pressure relief valve may be by other than the diverter valve described. For example, a piston-type valve, flap-valve or other mechanism may be used to manipulate the flow path of the coolant relieved through the pressure relief valve.

Of course, the foregoing description is that of preferred embodiments of the invention, and various changes and modifications may be made without departing from the spirit and scope of the invention, as defined by the appended claims.

What is claimed is:

1. An outboard motor powered by an internal combustion engine, said engine having at least one variable volume combustion chamber and a passage extending from each chamber to a muffler, said engine including a lubricating system comprising a lubricating oil supply positioned in an oil reservoir and means for supplying oil therefrom to said engine, said muffler and oil reservoir positioned within a housing of the outboard motor, said motor including a liquid cooling system, said cooling system including means for supplying liquid coolant to one or more passages within said engine, a thermostat positioned along one of said passages of said engine for controlling the flow of cooling water through said engine to a return line, said return line extending to a first coolant pool extending about at least a portion of said oil reservoir, and a pressure relief valve positioned along one of said passages of said engine, said pressure relief valve controlling the flow of liquid coolant to a relief line.

2. The outboard motor in accordance with claim 1, further including a first passage extending from said relief line to said first coolant pool, and a second line extending to other than said first coolant pool, and means for controlling the flow of liquid coolant through said relief line to said first or second lines.

3. The outboard motor in accordance with claim 2, wherein said second line extends to a second coolant pool extending about at least a portion of said muffler.

4. The outboard motor in accordance with claim 3, wherein said first pool is provided with an overflow leading to a liquid coolant outlet, and wherein said second pool is provided with an overflow leading to a liquid coolant outlet.

5. The outboard motor in accordance with claim 2, wherein said means for controlling the flow of liquid coolant causes liquid coolant flowing through said relief line to flow into said first line when a temperature of said lubricating oil is above a predetermined temperature.

6. The outboard motor in accordance with claim 2, wherein said means for controlling the flow of liquid coolant causes liquid coolant flowing through said relief line to flow into said second line when a temperature of said lubricating oil is below a predetermined temperature.

7. The outboard motor in accordance with claim 2, wherein said second line extends to a liquid coolant drain.

8. The outboard motor in accordance with claim 2, wherein said means for controlling comprises a diverter valve and means for moving said valve between a first position in which said second line is obscured and liquid coolant passes from said relief line to said first line, and a second position in which said first line is obscured and liquid coolant passes from said relief line to said second line.

9. The outboard motor in accordance with claim 8, wherein said means for moving said valve comprises a motor.

10. The outboard motor in accordance with claim 8, further including means for sensing the temperature of said lubricating oil and control means for controlling said means for moving said valve in response to the output of said means for sensing.

11. The outboard motor in accordance with claim 1, wherein said relief line extends to a liquid cooling drain for draining said liquid coolant from said motor.

12. The outboard motor in accordance with claim 1, wherein said engine has a top end and a bottom end, said bottom end positioned above an exhaust guide, and said muffler and oil reservoir positioned below said exhaust guide, and wherein said relief line extends into said exhaust guide, and said first and second lines extend through said exhaust guide from said relief line.

13. An outboard motor having an upper unit comprising a cowling housing an internal combustion engine and a lower unit housing a muffler and an oil reservoir, said engine having a generally vertically extending crankshaft whereby said engine has a top end and a bottom end, and a liquid cooling system for said motor, said cooling system including means for supplying coolant to passages in said engine, at least one return passage extending from said top end of said engine generally vertically downward to a first cooling pool, at least one thermostat positioned at said top end of said engine for controlling the flow of coolant from said engine to said at least one return passage, a pressure relief valve, and means for controlling a flow of coolant passing through said relief valve to either said pool or another location of said motor.

14. The outboard motor in accordance with claim 13, wherein said means for controlling comprises a diverter, and wherein a first coolant line is provided from said diverter to said pool.

15. The outboard motor in accordance with claim 14, wherein a second coolant line is provided from said diverter to a second coolant pool extending about at least a portion of said muffler.

16. The outboard motor in accordance with claim 14, wherein a second line is provided from said diverter to a coolant drain for draining said coolant from said motor.

17. The outboard motor in accordance with claim 16, wherein said second line extends to a chamber which is separate from said pool, said chamber having an overflow passage leading to a coolant drain.

18. The outboard motor in accordance with claim 13, wherein said first cooling pool extends about at least a portion of said oil reservoir.

19. An outboard motor having a cowling and a water propulsion device, an internal combustion engine positioned in said cowling, said engine having a body and an output shaft, said output shaft extending generally vertically and arranged to drive said water propulsion device, and a liquid cooling system for said motor, said cooling system including a coolant supply leading to an inlet of one or more coolant passages through said body and said cooling system including a coolant outlet leading from said one or more coolant passages through said body and a diverter positioned along said coolant outlet for diverting coolant to either a first coolant pool or another location of said motor.

20. The outboard motor in accordance with claim 19, including a lubricating system for lubricating one or more portions of said engine, said lubricating system including a lubricant reservoir, said first coolant pool surrounding at least a portion of said lubricant reservoir.

21. The outboard motor in accordance with claim 19, wherein said another location comprises a coolant drain from said motor.

22. The outboard motor in accordance with claim 19, wherein said cooling system including a thermostat controlling a flow of coolant from said coolant supply into said one or more coolant passages through said body of said engine.

23. The outboard motor in accordance with claim 19, wherein said outboard motor includes a muffler into which exhaust from said engine is routed and said another location comprises a second coolant pool at least partially surrounding said muffler.

24. The outboard motor in accordance with claim 19, wherein said cooling system includes a pressure relief valve, said pressure relief valve controlling a flow of coolant from said one or more passages through said body of said engine to a relief line, and wherein said diverter is positioned along said relief line.

25. The outboard motor in accordance with claim 19, wherein said diverter comprises a valve moveable between a first position in which coolant is permitted to flow to only said first coolant pool and a second position in which coolant is permitted to flow only to said another location of said motor.

26. The outboard motor in accordance with claim 25, wherein said motor includes a lubricating system including a lubricant reservoir and said first coolant pool surrounds at least a portion of said reservoir, and including a means for sensing a temperature of lubricant and a control for moving said valve to said first position when a temperature of said lubricant exceeds a predetermined temperature.

27. An outboard motor powered by an internal combustion engine, said engine having at least one combustion chamber and an output shaft arranged to drive a water propulsion device of said motor, said engine including a lubricating system comprising a lubricating oil supply positioned in a reservoir and means for supplying oil from said reservoir to said engine, said motor including a liquid cooling system, said cooling system including means for supplying coolant to one or more coolant passages within said engine, a thermostat positioned along one of said coolant passages of said engine for controlling the flow of coolant through said engine to a return line, said return line extending to a first coolant pool extending about at least a portion of said reservoir, and a pressure relief valve positioned along one of said coolant passages, said pressure relief valve controlling the flow of liquid coolant to a relief line.

28. The outboard motor in accordance with claim 27, including a first line extending from said relief line to said first coolant pool, a second line extending from said relief line to a point other than said first coolant pool, and means for controlling a flow of coolant through said relief line to said first or second line.

29. The outboard motor in accordance with claim 27, wherein said motor includes an exhaust system, said exhaust system including a muffler into which exhaust from said engine is routed, and wherein said first coolant pool extends about at least a portion of said muffler.

30. The outboard motor in accordance with claim 27, wherein said first coolant pool is provided with an overflow leading to a coolant outlet from said motor.

31. The outboard motor in accordance with claim 27, wherein said return line extends generally vertically downward from a top end of said engine to a bottom end of said engine.

32. The outboard motor in accordance with claim 27, including a first line extending from said relief line to said first coolant pool, a second line extending from said relief line to a point other than said first coolant pool, and means for controlling a flow of coolant through said relief line to said first or second line based upon a temperature of said lubricating oil.

* * * * *